US007264545B2

(12) United States Patent
Maya et al.

(10) Patent No.: US 7,264,545 B2
(45) Date of Patent: Sep. 4, 2007

(54) GAMING DEVICE HAVING SELECTABLE REVEALED AWARD VALUES

(75) Inventors: Darren Maya, Reno, NV (US); Joseph E. Kaminkow, Reno, NV (US); Anthony J. Baerlocher, Reno, NV (US); Cari L. Blomquist, Reno, NV (US)

(73) Assignee: IGT, Reno, NV (US)

( * ) Notice: Subject to any disclaimer, the term of this patent is extended or adjusted under 35 U.S.C. 154(b) by 632 days.

(21) Appl. No.: 10/210,154

(22) Filed: Jul. 31, 2002

(65) Prior Publication Data

US 2004/0023707 A1 Feb. 5, 2004

(51) Int. Cl.
*A63F 9/24* (2006.01)

(52) U.S. Cl. ..... 463/16; 463/17; 463/20; 273/138.1

(58) Field of Classification Search ..... 463/16–17, 463/20; 273/138.1, 273
See application file for complete search history.

(56) References Cited

U.S. PATENT DOCUMENTS

| | | | | |
|---|---|---|---|---|
| 3,642,287 A | | 2/1972 | Lally et al. | |
| 4,448,419 A | | 5/1984 | Telnaes | |
| 4,548,410 A | * | 10/1985 | Morrone | 273/153 S |
| 4,582,324 A | | 4/1986 | Koza et al. | |
| 4,624,459 A | | 11/1986 | Kaufman | |
| 4,695,053 A | | 9/1987 | Vazquez, Jr. et al. | |
| 4,820,908 A | * | 4/1989 | Wei | 463/48 |
| 4,991,848 A | | 2/1991 | Greenwood et al. | |
| 5,152,529 A | | 10/1992 | Okada | |
| 5,178,390 A | | 1/1993 | Okada | |
| 5,205,555 A | | 4/1993 | Hamano | |
| 5,342,047 A | | 8/1994 | Heidel et al. | |

(Continued)

FOREIGN PATENT DOCUMENTS

EP 0874337 A1 10/1998

(Continued)

OTHER PUBLICATIONS

Let's Make a Deal, Show Info [online], [retrieved on Jan. 19, 2007]. Retrieved from the Internet <Url: http://www.letsmakeadeal.com/showinfo.htm>.*

(Continued)

*Primary Examiner*—Robert E Pezzuto
*Assistant Examiner*—David W Duffy
(74) *Attorney, Agent, or Firm*—Bell, Boyd & Lloyd LLP

(57) ABSTRACT

A processor controlled gaming device having a display device, wherein the display device shows the player an offer, enables the player to keep the offer and provides a pre-defined number of chances for the player to change a component of or upgrade the offer. The player may use all the chances, wherein the game awards the final offer or keep any one of the initial or intermediate offers. In a general embodiment, the game displays a plurality of masked values and a plurality of displayed values on the display device. The initial offer is a combination and preferably an addition of each of the displayed values. The game in one preferred general embodiment allows the player to select the displayed value to mask and thus remove from the offer and the masked value to reveal and add to the offer.

65 Claims, 15 Drawing Sheets

U.S. PATENT DOCUMENTS 5,456,465 A 10/1995 Durham
5,524,888 A 6/1996 Heidel
5,536,016 A 7/1996 Thompson
5,542,669 A 8/1996 Charron et al.
5,560,603 A 10/1996 Seelig et al.
5,611,535 A 3/1997 Tiberio
5,711,525 A 1/1998 Breeding
5,769,716 A 6/1998 Saffari et al.
5,772,509 A 6/1998 Weiss
5,775,692 A 7/1998 Watts et al.
5,788,573 A 8/1998 Baerlocher et al.
5,823,874 A 10/1998 Adams
5,833,538 A 11/1998 Weiss
5,848,932 A 12/1998 Adams
5,851,148 A 12/1998 Brune et al.
5,873,781 A 2/1999 Keane
5,882,261 A 3/1999 Adams
5,902,184 A 5/1999 Bennett
5,911,418 A 6/1999 Adams
5,947,820 A 9/1999 Morro et al.
5,951,397 A 9/1999 Dickinson
5,964,463 A 10/1999 Moore, Jr.
5,967,894 A 10/1999 Kinoshita et al.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,015,346 A * 1/2000 Bennett ..... 463/20
6,019,369 A 2/2000 Nakagawa et al.
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,086,066 A 7/2000 Takeuchi et al.
6,089,976 A 7/2000 Schneider et al.
6,089,977 A 7/2000 Bennett
6,089,978 A 7/2000 Adams
6,093,102 A 7/2000 Bennett
6,102,798 A * 8/2000 Bennett ..... 463/16
6,120,031 A 9/2000 Adams
6,126,541 A 10/2000 Fuchs
6,126,542 A 10/2000 Fier
6,142,873 A 11/2000 Weiss et al.
6,142,874 A 11/2000 Kodachi et al.
6,142,875 A 11/2000 Kodachi et al.
6,146,273 A 11/2000 Olsen
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,190,254 B1 2/2001 Bennett
6,190,255 B1 2/2001 Thomas et al.
6,203,429 B1 3/2001 Demar et al.
6,210,279 B1 4/2001 Dickinson
6,213,876 B1 4/2001 Moore, Jr.
6,224,483 B1 5/2001 Mayeroff
6,231,442 B1 5/2001 Mayeroff
6,231,445 B1 5/2001 Acres
6,257,981 B1 * 7/2001 Acres et al. ..... 463/26
6,261,177 B1 7/2001 Bennett
6,302,790 B1 10/2001 Brossard
6,305,686 B1 10/2001 Perrie et al.
6,309,300 B1 * 10/2001 Glavich ..... 463/26
6,328,649 B1 12/2001 Randall et al.
6,375,187 B1 4/2002 Baerlocher
6,494,785 B1 12/2002 Gerrard et al.
6,506,118 B1 1/2003 Baerlocher et al.
6,514,141 B1 2/2003 Kaminkow et al.
6,569,015 B1 5/2003 Baerlocher et al.
6,575,830 B2 6/2003 Baerlocher et al.
6,589,114 B2 7/2003 Rose
6,599,192 B1 7/2003 Baerlocher et al.
6,605,002 B2 8/2003 Baerlocher
6,609,974 B2 8/2003 Mead et al.
6,632,141 B2 10/2003 Webb et al.
6,645,074 B2 * 11/2003 Thomas et al. ..... 463/20
6,648,754 B2 11/2003 Baerlocher et al.
6,692,355 B2 2/2004 Baerlocher et al.
6,719,632 B2 4/2004 Palmer et al.
6,722,981 B2 4/2004 Kaminkow et al.
6,722,982 B2 4/2004 Kaminkow et al.
6,758,750 B2 7/2004 Baerlocher et al.
6,786,820 B2 9/2004 Gerrard et al.
6,793,579 B2 9/2004 Baerlocher et al.
6,796,905 B2 9/2004 Baerlocher et al.
6,808,452 B2 10/2004 Baerlocher et al.
6,808,454 B2 10/2004 Gerrard et al.
6,811,483 B1 11/2004 Webb et al.
6,852,030 B2 2/2005 Baerlocher et al.
6,890,257 B2 5/2005 Baerlocher
6,899,623 B2 5/2005 Baerlocher
6,942,566 B2 9/2005 Baerlocher et al.
6,942,567 B2 9/2005 Baerlocher et al.
6,960,132 B2 11/2005 Baerlocher et al.
6,966,833 B2 11/2005 Kaminkow et al.
6,971,953 B2 12/2005 Gerrard et al.
7,001,273 B2 2/2006 Baerlocher
2002/0072402 A1 6/2002 Baerlocher
2002/0142822 A1 10/2002 Baerlocher et al.
2002/0155883 A1 10/2002 Baerlocher
2002/0183109 A1 12/2002 McGahn et al.
2003/0040360 A1 2/2003 Kaminkow
2003/0045348 A1 3/2003 Palmer et al.
2003/0045350 A1 3/2003 Baerlocher et al.
2003/0060260 A1 3/2003 Gerrard et al.
2003/0064795 A1 4/2003 Baerlocher et al.
2003/0078093 A1 4/2003 Simms et al.
2003/0078096 A1 4/2003 Kaminkow et al.
2003/0087693 A1 5/2003 Baerlocher et al.
2003/0119583 A1 6/2003 Kaminkow et al.
2003/0157982 A1 8/2003 Gerrard et al.
2003/0162578 A1 8/2003 Baerlocher et al.
2003/0162584 A1 8/2003 Hughs-Baird et al.
2003/0195027 A1 10/2003 Baerlocher et al.
2004/0038729 A1 2/2004 Webb et al.
2004/0180710 A1 9/2004 Palmer et al.
2004/0185928 A1 9/2004 Baerlocher et al.
2004/0214632 A1 10/2004 Cuddy et al.
2005/0020346 A1 1/2005 Baerlocher
2005/0037829 A1 2/2005 Baerlocher et al.
2005/0101375 A1 5/2005 Webb et al.
2005/0130729 A1 6/2005 Baerlocher et al.
2005/0187010 A1 8/2005 Baerlocher
2005/0266914 A1 12/2005 Baerlocher et al.
2006/0003837 A1 1/2006 Baerlocher et al.

FOREIGN PATENT DOCUMENTS

EP 0926645 A2 6/1999
EP 0944030 A2 9/1999
EP 0945837 A2 9/1999
EP 0981119 A2 2/2000
EP 0984408 A2 3/2000
EP 0984409 A2 3/2000
GB 2385701 A 8/2003
GB 2405981 A 3/2005

| | | | |
|---|---|---|---|
| GB | 2404770 | A | 9/2005 |
| WO | WO9732285 | | 9/1997 |
| WO | WO 00/12186 | | 3/2000 |
| WO | WO 01/69551 | A3 | 9/2001 |
| WO | WO 03/026750 | A3 | 4/2003 |
| WO | WO 03/075236 | A2 | 9/2003 |
| WO | WO 03/075237 | A2 | 9/2003 |
| WO | WO 03/102844 | A2 | 12/2003 |

OTHER PUBLICATIONS

Addams Family Advertisement and Article written by IGT, Strictly Slots, published in 2000.
Adders and Ladders Advertisement written by Barcrest Ltd., published prior to 2000.
American Thunder Screen Shots written by IGT, published in 1998.
Big Bang Piggy Bankin Advertisement written by WMS Gaming, Inc., published prior to 2000.
Blackjack/Twenty-One Description written by Hoyle's Rules of Games, published in 1993.
Bonus Spin Red, White & Blue Advertisement written by IGT, published in 2000.
Bonus Times Article written by Strictly Slots, published in 2000.
By George Advertisement, written by IGT, published in 2002.
Caribbean Gold II Advertisement written by Aristocrat Incorporated, published in 1998.
Cash Box Advertisement & Article written by Anchor Games, Strictly Slots, published in 2000.
Chutes & Ladders Game Instructions written by Hasbro-Milton Bradley, published in 1999.
Deep Pockets Article, written by Strictly Slots, published in 2002.
Description of Let's Make a Deal Television Show written by letsmakeadeal.com (2 pages), printed on Mar. 16, 2001.
Double Diamond Game Descriptions written by IGT printed on Mar. 21, 2001.
Double Up Poker Game Description written by IGT Undated.
Easy Street Advertisements and Articles written by Casino Data Systems, published in 2000.
Elvis Advertisement written by IGT, published in 1999.
Empire Game Advertisement written by AC Coin, published in 1996.
Fire and Fortune Article written by Strictly Slots, published in 2001.
Fox "N" Hound Advertisement written by IGT, published in 2000.
In Between Game Description written by IGT, available prior to 2000.
Jackpot Party Advertisements and Articles written by WMS Gaming, Inc., published in 1998.
Keep Your Hat On Advertisement written by Aristocrat, published in 2001.
Let's Make a Deal written by geocities.com (10 pages), printed on Mar. 21, 2001.
Let's Make a Deal written by fortunecity.com (4 pages), printed on Mar. 21, 2001.
Let's Make a Deal written by Illinoislottery.com (1 page), printed on Mar. 21, 2001.
Let's Make a Deal geocities.com (2 pages), printed on Mar. 16, 2001.
Let's Make A Deal Advertisement written by Shuffle Master and IGT, published in 2001.
Let's Make a Deal Game Advertisement written by Bally Gaming Systems, published in 1999.
Lifestyles of the Rich & Famous Advertisment, written by IGT, published in 2002.
Little Green Men Advertisement and Article written by IGT, Strictly Slots, published in 2000.
MegaJackpots Advertisement written by IGT, published in 1998.
Money Grab Article written by Strictly Slots, published in Apr. 2001.
Money in the Bank Advertisement written by Strictly Slots Konami, published in 2001.
Monopoly Advertisements and Articles written by WMS Gaming, Inc., Strictly Slots, published in 1998, 1999, 2000.
Monopoly Party Train Article written by Strictly Slots, published in 2002.
Neon Nights written by IGT, published in 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Article written by Strictly Slots, published in Mar. 2001.
Take Your Pick Advertisement written by IGT/Anchor Gaming, published in 1999.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Cat Advertisement written by WMS Gaming, Inc., published prior to 2000.
Top Dollar Game Advertisement written by IGT, published in 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming, Inc., published in 1998.

* cited by examiner

GAMING DEVICE HAVING SELECTABLE REVEALED AWARD VALUES

CROSS REFERENCE TO RELATED APPLICATIONS

The present invention relates to the following commonly owned U.S. patent applications: "GAMING DEVICE HAVING SEPARATELY CHANGEABLE VALUE AND MODIFIER BONUS SCHEME," Ser. No. 09/626,045, now U.S. Pat. No. 6,569,015; "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601, "GAMING DEVICE HAVING A DESTINATION PURSUIT BONUS SCHEME WITH ADVANCED AND SETBACK CONDITIONS," Ser. No. 09/686,409, now U.S. Pat. No. 6,494,785; "GAMING DEVICE HAVING VALUE SELECTION BONUS," Ser. No. 09/684,605, now U.S. Pat. No. 6,514,141; "GAMING DEVICE HAVING RISK EVALUATION BONUS ROUND," Ser. No. 09/688,434, now U.S. Pat. No. 6,599,192; "GAMING DEVICE HAVING AN IMPROVED OFFER/ACCEPTANCE BONUS SCHEME," Ser. No. 09/966,884, "GAMING DEVICE HAVING IMPROVED OFFER AND ACCEPTANCE BONUS SCHEME," Ser. No. 09/680,630, now U.S. Pat. No. 6,375,187; "GAMING DEVICE HAVING IMPROVED AWARD OFFER BONUS SCHEME," Ser. No. 09/682,368, now U.S. Pat. No. 6,506,118; "GAMING DEVICE HAVING OFFER ACCEPTANCE GAME WITH TERMINATION LIMIT," Ser. No. 09/822,711, "GAMING DEVICE HAVING OFFER/ACCEPTANCE ADVANCE THRESHOLD AND LIMIT BONUS SCHEME," Ser. No. 09/838,014, "GAMING DEVICE HAVING AN OFFER AND ACCEPTANCE SELECTION BONUS SCHEME WITH A TERMINATOR AND AN ANTI-TERMINATOR," Ser. No. 09/945,082, now U.S. Pat. No. 6,632,141; "GAMING DEVICE HAVING AN AWARD OFFER AND TERMINATION BONUS SCHEME," Ser. No. 09/682,428, "DEVICE HAVING AN OFFER AND ACCEPTANCE GAME WITH A PLAYER SELECTION FEATURE." Ser. No. 10/086,078, "GAMING DEVICE HAVING OFFER AND ACCEPTANCE GAME WITH A PLURALITY OF AWARD POOLS, A REVEAL FEATURE, AND A MODIFY FEATURE." Ser. No. 10/255,862, "GAMING DEVICE HAVING IMPROVED OFFER AND ACCEPTANCE BONUS SCHEME," Ser. No. 10/074,273, "GAMING DEVICE HAVING AN AWARD EXCHANGE BONUS ROUND AND METHOD FOR REVEALING AWARD EXCHANGE POSSIBILITIES." Ser. No. 10/165,132, "GAMING DEVICE HAVING AN OFFER/ACCEPTANCE GAME WITH MULTI-OFFER SYMBOL." Ser. No. 10/245,387, "GAMING DEVICE HAVING AN AWARD OFFER AND TERMINATION BONUS SCHEME." Ser. No. 10/241,248, "GAMING DEVICE HAVING AN OFFER/ACCEPTANCE GAME WHEREIN EACH OFFER IS BASED ON A PLURALITY OF INDEPENDENTLY GENERATED EVENTS." Ser. No. 10/244,134, "GAMING DEVICE HAVING A DESTINATION PURSUIT BONUS SCHEME WITH ADVANCED AND SETBACK CONDITIONS." Ser. No. 10/288,750, "GAMING DEVICE HAVING IMPROVED AWARD OFFER BONUS SCHEME." Ser. No. 10/290,800, "GAMING DEVICE HAVING VALUE SELECTION BONUS." Ser. No. 10/306,295, "GAMING DEVICE HAVING IMPROVED AWARD OFFER BONUS SCHEME." Ser. No. 10/318,752, "GAMING DEVICE HAVING A DESTINATION PURSUIT BONUS SCHEME WITH ADVANCED AND SETBACK CONDITIONS." Ser. No. 10/393,201, "GAMING DEVICE HAVING VALUE SELECTION BONUS." Ser. No. 10/354,514, "GAMING DEVICE HAVING SEPARATELY CHANGEABLE VALUE AND MODIFIER BONUS SCHEME." Ser. No. 10/410,019, "GAMING DEVICE HAVING RISK EVALUATION BONUS ROUND." Ser. No. 10/616,563, "GAMING DEVICE HAVING RISK EVALUATION BONUS ROUND." Ser. No. 10/454,337, "GAMING DEVICE HAVING AN OFFER AND ACCEPTANCE SELECTION BONUS SCHEME WITH A TERMINATOR AND AN ANTI-TERMINATOR." Ser. No. 10/644,447, "GAMING DEVICE HAVING AN OFFER AND ACCEPTANCE GAME WITH MULTIPLE OFFERS." Ser. No. 10/657,442, "GAMING DEVICE HAVING A SELECTION GAME WITH BUILDING AWARDS." Ser. No. 10/649,092, "GAMING DEVICE HAVING AN AWARD EXCHANGE BONUS ROUND AND METHOD FOR REVEALING AWARD EXCHANGE POSSIBILITIES." Ser. No. 10/629,416, "GAMING DEVICE HAVING A DESTINATION PURSUIT BONUS SCHEME WITH ADVANCED AND SETBACK CONDITIONS." Ser. No. 10/660,075, and "GAMING DEVICE HAVING AN OFFER AND ACCEPTANCE GAME WITH A TERMINATION LIMIT WHEREIN THE OFFER IS PICKED BY A PLAYER." Ser. No. 10/678,656,

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device: (i) having player selectable revealed award values; (ii) using visual representations of sliding tiles, blocks and other objects; and (iii) providing an offer and acceptance game, wherein the player rejects an offer by covering one displayed value to reveal another.

BACKGROUND OF THE INVENTION

Gaming devices currently exist with bonus rounds in which a player has one or more opportunities to choose masked bonus awards from a pattern of masked awards displayed to the player. When the player chooses a masked award from the pattern, the game removes the mask and either awards the player with a bonus value or terminates the bonus round with a bonus terminator. The outcome depends upon whether the player selects an award or a terminator.

In the above game, the controller of the gaming device randomly places a predetermined number of masked awards and terminators in the pattern at the beginning of the bonus round and maintains the positioning until the bonus round terminates. When the player selects a masked award, the player receives the value of the award, and the game typically displays a message that the player may continue and enables the player to select another masked award. The player then selects another masked award, and the process continues until the player selects a masked terminator. U.S. Pat. No. 6,190,255 B1, which issued on Feb. 20, 2001, and which is assigned on its face to WMS Gaming Inc., discloses a bonus game of this type.

Gaming machines also currently exist with bonus rounds in which the game selects or determines the player's award. PCT application PCT/AU97/00121 entitled, Slot Machine Game with Roaming Wild Card, having a publication date of Sep. 4, 1997, discloses an example. In this game, a slot machine having a video display contains a plurality of rotatable reels with game symbols. When the player receives a triggering symbol or combination, the game produces a bonus symbol. The bonus symbol appears at each game symbol to temporarily change the game symbol to a bonus symbol. If the change results in a winning combination, the player receives an award.

In the first known game, the "go-until" or "do-until" bonus can end quite quickly if the player selects a bonus terminator early in the bonus round. The player selects masked symbols until selecting the bonus terminator, which is immediately displayed. The player's involvement in the bonus round is thus limited. The player has no opportunity to undo or redo an undesired pick. The player has no opportunity to optimize or maximize the bonus round award. In the second known game, the game completely determines the bonus round award, and the player has no effect on the outcome.

Another well known game provides a player with a series of offers, where each offer includes a number of credits, coins, tokens or dollars. The player may accept or reject each offer prior to the final offer. The offers are randomly determined from a series of potential offers of differing values. If the player accepts an offer, the game provides the offer to the player. If the player rejects an offer, the gaming device provides another offer to the player, as long as the current offer is not the final offer. The player is automatically provided the final offer. This type of gaming device has achieved significant popularity in the gaming industry.

Gaming devices provide enjoyment and excitement to the player, in part, because they may ultimately lead to a monetary award. Gaming devices also provide enjoyment and excitement to the player because they are fun to play. Bonus games, in particular, provide gaming device manufacturers with the opportunity to add enjoyment and excitement to that which is already expected from a base game of the gaming device. Bonus games provide extra awards to the player and enable the player to play a game that is different than the base game.

A continuing need exists to provide gaming devices that issue awards in an exciting and enjoyable manner. In this respect, it is desirable to enable the player to have an impact on determining the player's award. It is also desirable to enable a player to optimize an award. It is further desirable to increase the level of player interaction. It is still further desirable to implement these features in an offer and acceptance type of game and as a primary or secondary game.

SUMMARY OF THE INVENTION

The present invention provides a gaming device that enables the player to change components of an award ultimately provided to the player. More specifically, the present invention provides a processor controlled gaming device having a display device controlled by the processor, wherein the display device displays an offer to the player, enables the player to keep the offer and enables the player to change a component of the offer. The game provides a predefined number of chances for the player to upgrade the offer. The player may use all the chances, wherein the game awards the final offer to the player. The player may otherwise keep any one of the initial or intermediate offers.

In one general embodiment, the game displays a plurality of masked values and a plurality of displayed values on the display device. The initial offer is a combination, e.g., a sum, multication or a combination of these, and preferably a sum of each of the displayed values. The game in one general embodiment provides a separate reject offer input. When the player presses the reject offer input, the game randomly chooses which displayed value to mask (i.e., remove from the offer) and which masked value to reveal (i.e., add to the offer). This embodiment is completely random and the player has no control over the value to remove from the offer and the value to add to the offer.

In another general embodiment, the player selects which displayed value to mask or remove from the offer, and the game randomly picks the value to unmask or reveal and add to the offer. This embodiment enables the player to mask the lowest or-smallest displayed value on the display device and thereby remove it from the offer. The game randomly selects the replacement.

In a further general embodiment, the player selects the value to unmask or reveal and add to the offer, and the game randomly picks which displayed value to mask or remove from the offer. This embodiment enables the player to unmask or reveal a previously masked value that the player knows is relatively large. The game randomly selects the displayed value to mask and remove from the offer.

In yet another general embodiment, the player selects which displayed value to mask or remove from the offer and the value to unmask or reveal and add to the offer. In this embodiment, the processor does not randomly select either. This embodiment enables the player to mask the lowest or smallest displayed value on the display device and thereby remove it from the offer and enables the player to unmask or reveal a previously masked value that the player knows is larger.

The game includes each of these variations in player selectivity and random game generation in an embodiment where one or more masked values is linked to at least one displayed value. The links may be adapted to form individual horizontal, vertical or diagonal rows or groups. In this embodiment, the player preferably selects a mask to reveal, and the game covers or masks a displayed value in the same row as the mask. If two displayed values exist in the row, the game preferably prompts the player to pick one of the values to mask and remove from the offer. Otherwise, the game may be adapted to automatically pick the smallest value or the value closest to the player selected masked value.

In one preferred embodiment, the game links a plurality of the rows or groups to form a rectangular or square grid, wherein masks are rectangular or square tiles. In this embodiment, when the player selects a tile to reveal and thus a value to add to the offer, the game may mask a revealed value in the same row or column as the selected mask. If two or more revealed values exist in the same row or column as the selected tile, the game again preferably asks the player which value to mask and thus remove from the offer. Otherwise, the game may again be adapted to automatically pick the smallest value or the value closest to the player selected tile. It should be appreciated that the present invention can be employed without the offer and acceptance game play where the player causes the movement of the masks or tiles to reveal award symbols or other symbols which are otherwise used in a primary or secondary game.

It is therefore an advantage of the present invention to provide an improved offer and acceptance game.

It is another advantage of the present invention to provide an offer and acceptance game that enables the payer to change or upgrade a component of the offer.

It is a further advantage of the present invention to provide an offer and acceptance game that enables the player to remove an undesirable component from the player's offer.

It is yet another advantage of the present invention to provide an offer and acceptance game that enables the player to add a desirable component to the player's offer.

It is yet a further advantage of the present invention to provide an offer and acceptance game that enables the player to remove an undesirable component from the player's offer and add a desirable component to the player's offer.

It is still another advantage of the present invention to link masked values in a row or group, enable a player to select a masked value from a group and mask or remove a displayed value in the group.

It is still a further advantage of the present invention to link a plurality of rows and form a grid, enable a player to select a masked value or tile from the grid and mask or remove a displayed value from a row or column encompassing the selected tile.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
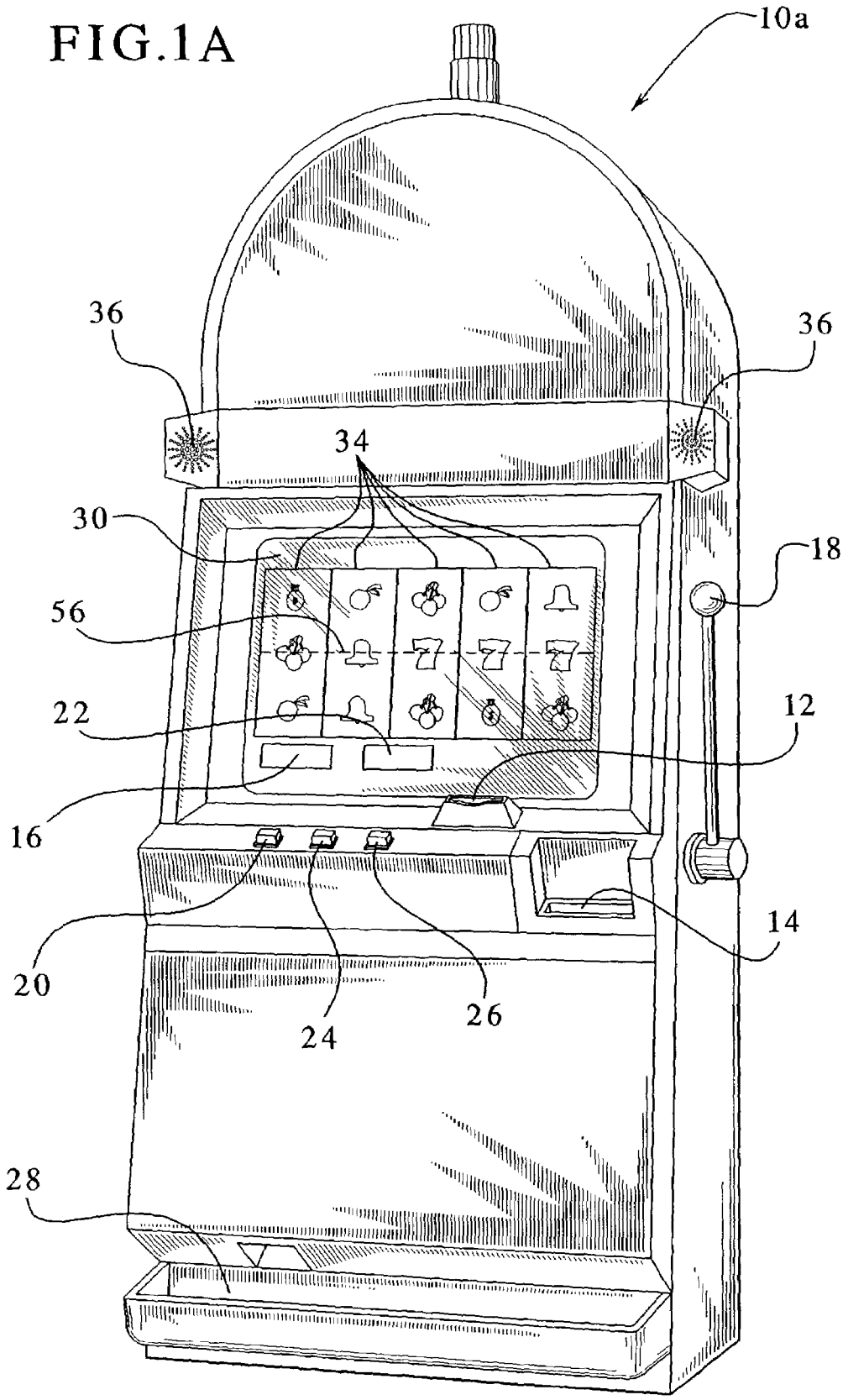
FIGS. 1A and 1B are perspective views of alternative embodiments of the gaming device of the present invention.
Figure 1B:
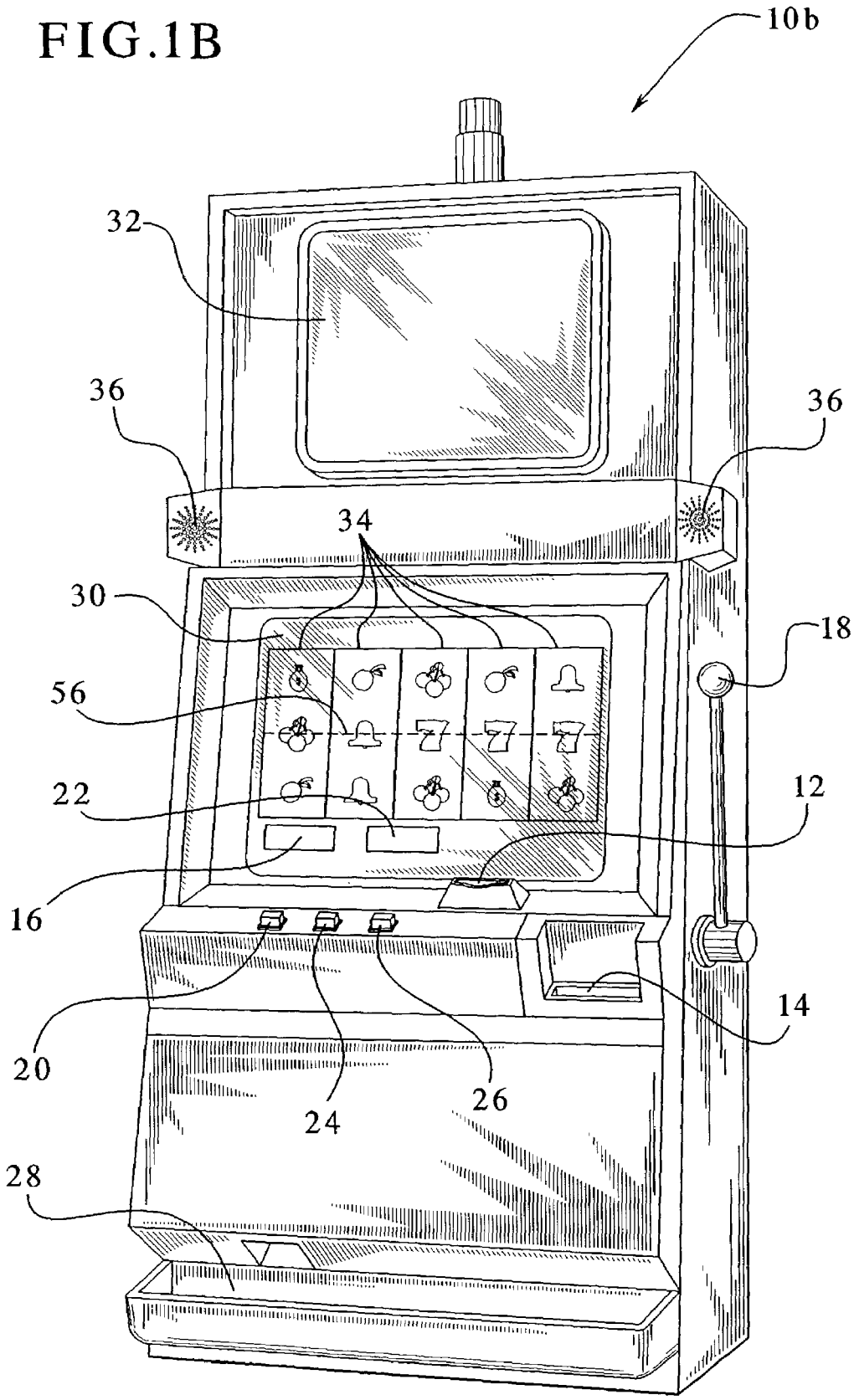

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 may display a plurality of reels 34 such as three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
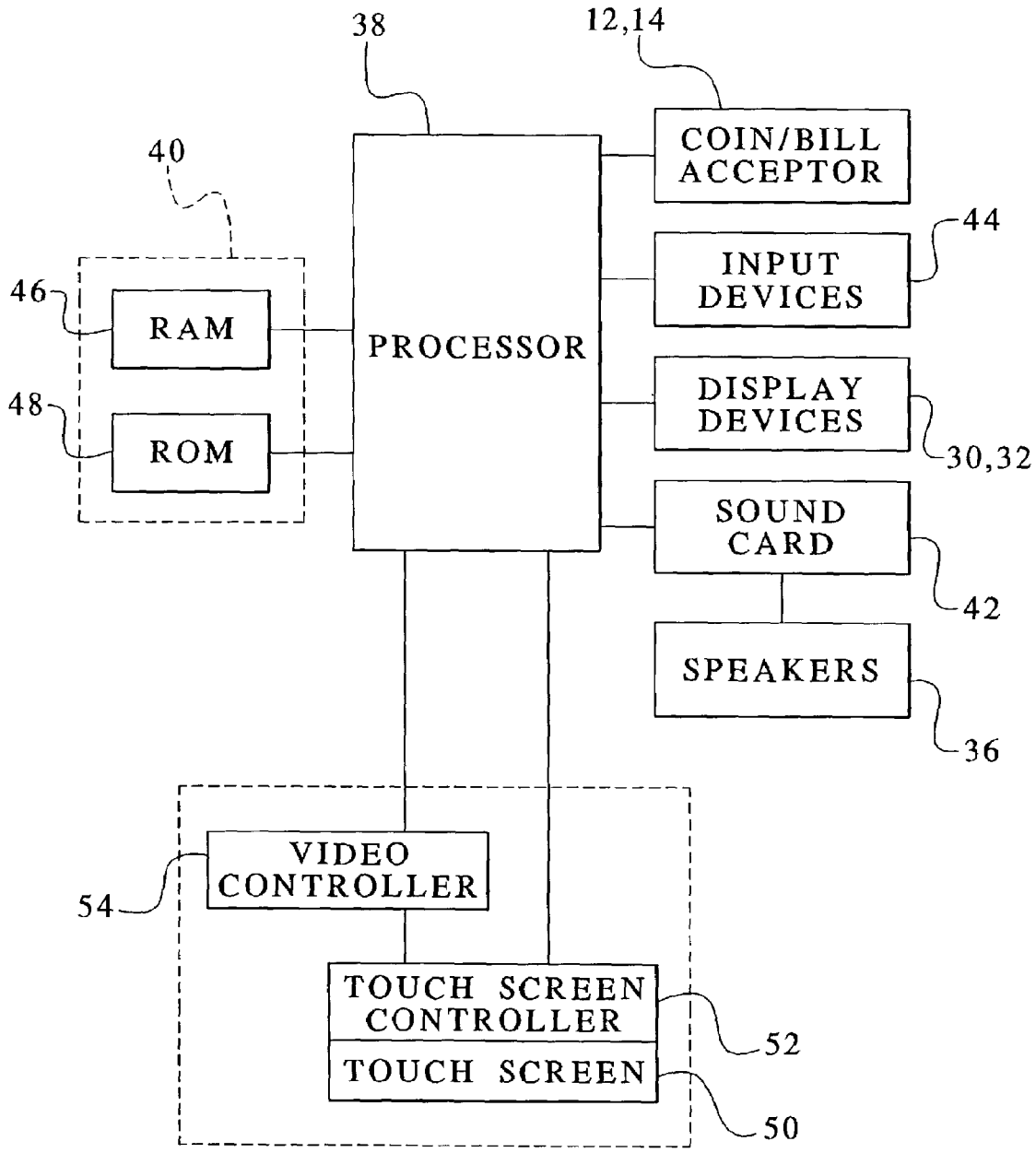
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Player Selectable Revealed Award Values

Figure 3A:
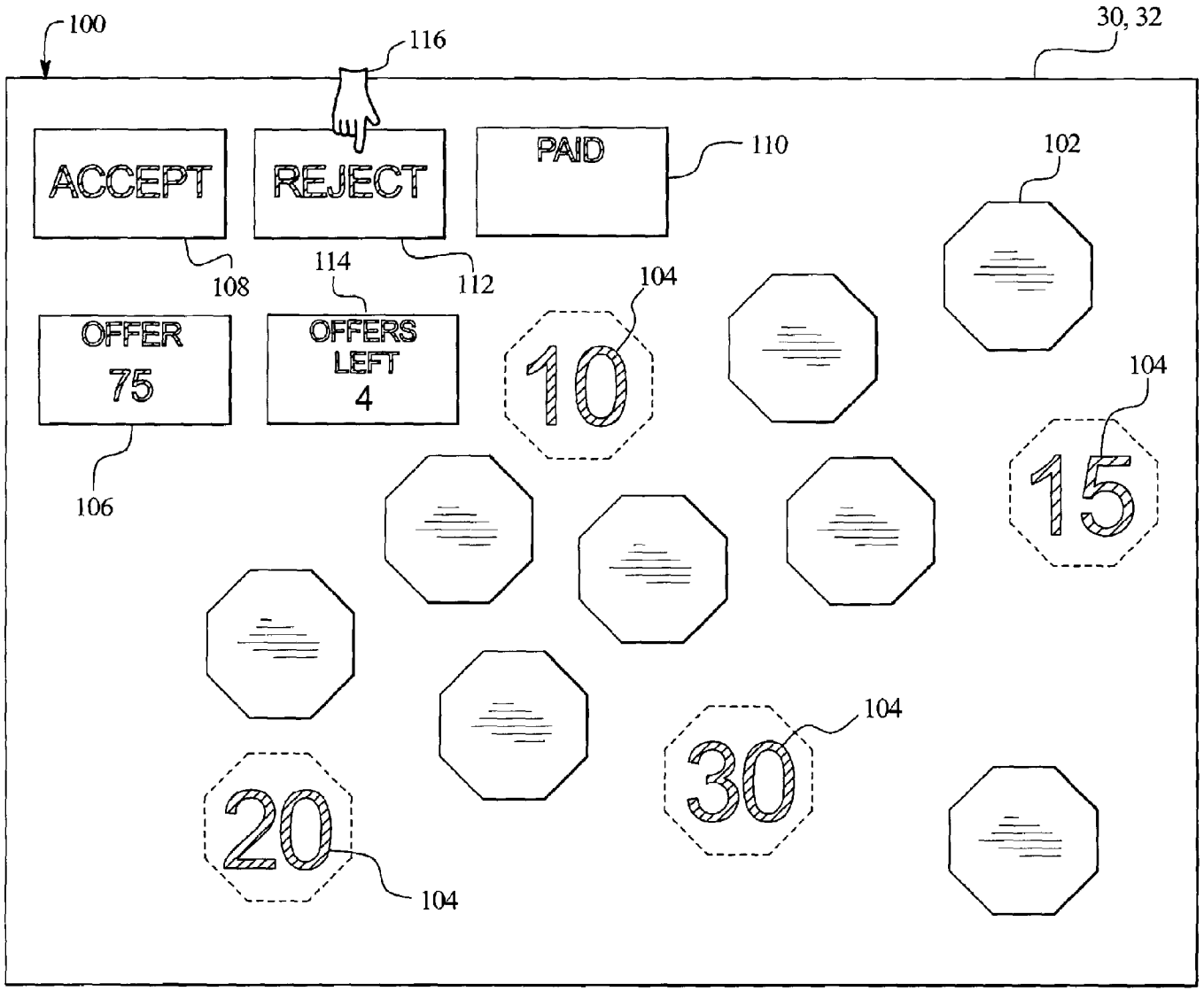
FIGS. 3A through 3D are front elevation views of a general embodiment of the present invention, wherein the player is enabled to reject an offer and replace a component of the offer.

Referring now to FIGS. 3A though 3C, one embodiment of the present invention is illustrated, wherein the game provides an offer and an option for the player to upgrade the offer by replacing values that make up the offer. In FIG. 3A, a screen 100 displays a plurality of masks 102 and unmasked values 104. The unmasked values 104 are illustrated with the outline of the mask 102 in phantom to indicate that they may have at one time or may at another time be covered or blocked from view by a mask.

The values 104 can represent any type of gaming device 10 value, such as a number of game credits, a game credit multiplier or a number of selections from a prize pool. A portion of the values 104 may be multipliers. If so, the multiplier values 104 preferably also display a multiplication operator in addition to the value such as 3× to indicate that the remaining credit values are multiplied by 3. The multiplier values 104 preferably multiply the total of the remaining credit values displayed by the screen 100. Alternatively, if each of the values 104 is a multiplier, the game preferably adds the multiplier values 104 and multiplies another number of game credits displayed elsewhere on the gaming device 10, such as the player's total bet, bet per one or more active paylines, total credits indicated by the credit display 16 or total win on one or more paylines.

For purposes of illustrating the present invention, the values 104 are game credit values unless otherwise stated. The screen 100 includes an offer display 106, which displays a mathematical combination of the values 104. If each of the values 104 is a number of game credits, the offer display 106 shows the addition of the game credit values 104. Where one or more of the values 104 is a multiplier, the offer display 106 preferably shows the sum of the multiplier values 104 multiplied by the sum of the credit values 104. In the screen 100, the ten, fifteen, twenty and thirty values 104 are each a number of game credits, so the offer display 106 shows an offer of seventy-five game credits.

An accept offer input 108 enables the player to keep or download an offer displayed by the offer display 106. Upon selecting the accept offer input 108, the game downloads the offer to the player. The screen 100 also includes a paid display 110, which shows when the game has paid a number of credits to the player. When the game downloads the offer to the player, the offer appears in the paid display 110. The screen 100 may also be adapted to include a simulated form of the credit display 16 (FIGS. 1A and 1B). In any case, after downloading the offer to the player, the credit display 16 updates accordingly, and the player may thereafter use the credits of the offer to play gaming device 10 or to cash out via the cash out button 26.

In an embodiment illustrated by the screen 100, the game includes a reject offer input 112. If the player is not satisfied with the current offer displayed by the offer display 106, the game enables the player to select that the game generate another offer via the reject offer input 112. An offers remaining display 114 indicates how many more new offers that the game will provide to the player. That is, the offers remaining display 114 indicates how many more times the player, in an embodiment, may select the reject offer input 112. In one embodiment, at the start of the game, the game provides four new offers to the player.

The accept offer input 108, the reject offer input 112 and all other player selectable inputs hereafter described in connection with the player selectable revealed award values of the present invention are preferably areas of a touch screen 50 (FIG. 2) in communication with the processor 38 and a touch screen controller 52. The accept offer input 108 and the reject offer input 112 are alternatively separate electromechanical input devices, mounted elsewhere on gaming device 10, which are in communication with the processor 38.

Figure 3B:
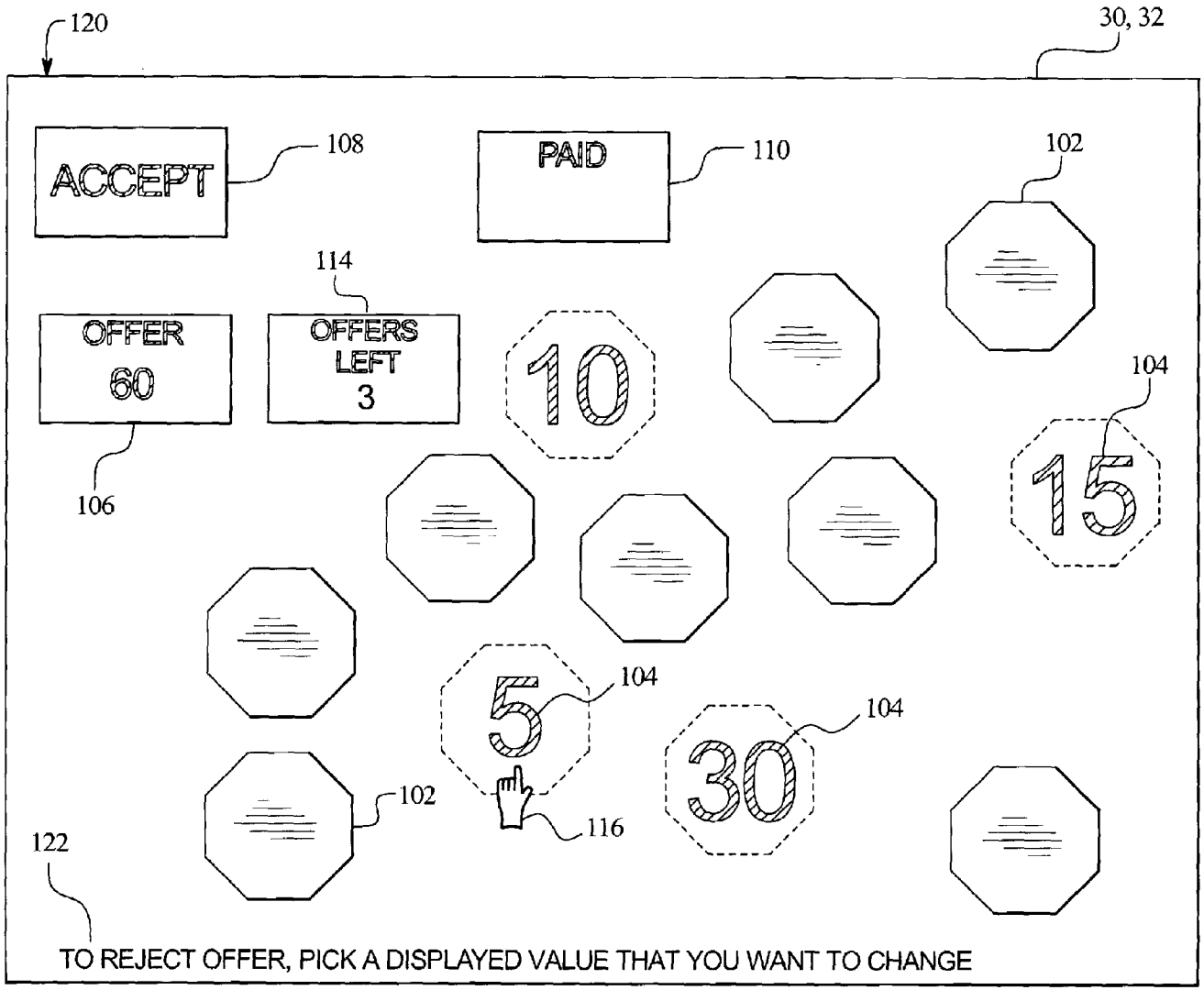

As illustrated in FIG. 3A, the player 116 decides to reject the seventy-five offer displayed in the offer display 106 and presses the reject offer input 112. Referring now to FIG. 3B, a screen 120 illustrates that the player's rejection of the offer in the screen 100 has caused the game to perform two random actions affecting the player's offer. First, the game masked or covered the twenty value 104 in the screen 100 and subtracted twenty credits from the player's offer. Second, the game unmasked the five value 104 in the screen 120 and added five credits to the player's offer.

The game in this embodiment chooses which value 104 to mask and which mask 102 to reveal according to a straight, non-weighted probability. The game also is able to mask values 104 that the game has previously unmasked and reveal masks 102 covering values 104 that the game has previously masked. The net effect of negative fifteen credits is reflected in the offer displays 106 of the screens 100 and 120. The player's offer is now only 60. The game also subtracts an offer from the offers remaining display 114.

The terms "mask," "cover" and "display in place of" or words to that effect are used interchangeably herein. Each of the terms includes displaying a mask such as the mask 102 on top of the respective masked value. Each of the terms also includes displaying the mask instead of displaying the respective value. Gaming device 10 can be programmed to operate either way, which makes no difference to the eyes of the viewer.

In an alternative embodiment, the game partially masks the value 104 or greys out the mask 102 covering the value 104. Here, the mask 102 is visible as is the value, e.g., the twenty value (not illustrated). The value 104 is slightly obscured by the mask 102. This embodiment enables the player to remember: (i) which values were previously offered and (ii) the amount of the values.

In the embodiment illustrated by the screen 100 and 120, three random generations take place. The first random generation, common to each embodiment of the present invention, is the game's placement of values 104 behind the masks 102. The game does this at the start of the game and preferably maintains the placement throughout the game. That is, if the game subsequently reveals the mask 102 in the lower left corner of the display device 30 or 32, the value 104 revealed is preferably still twenty as it is in the screen 100.

The memory device 40 stores a database of the values 104 (not illustrated) and one or more random generation devices (not illustrated) that, at an appropriate time as directed by the processor 38, randomly generate(s) values for each portion or mask 102 illustrated on the display device 30 or 32. The database of values 104 may be weighted such that the random generation device is more likely to select one or more values 104 more often than one or more other values 104.

The second random generation as illustrated by the screens 100 and 120 is the random selection of the value 104 that the game unreveals or masks. The third random generation is the random selection of the mask 102 that the game reveals. In this embodiment, the player has no way to make up for what turns out to be a bad decision to reject an offer. If the player rejects the offer of sixty, the game may again randomly mask a currently displayed value 104 that is higher than the newly displayed value 104 that the game reveals. To help the player, the game of this embodiment may be adapted to display the contents of the database of values 104 stored in the memory device 40, so that the player sees whether the displayed values 104 are on average relatively high or low. Otherwise, the player must compare the currently displayed values 104 with any previously displayed values to determine if the current offer is relatively high or low.

Figure 3C:
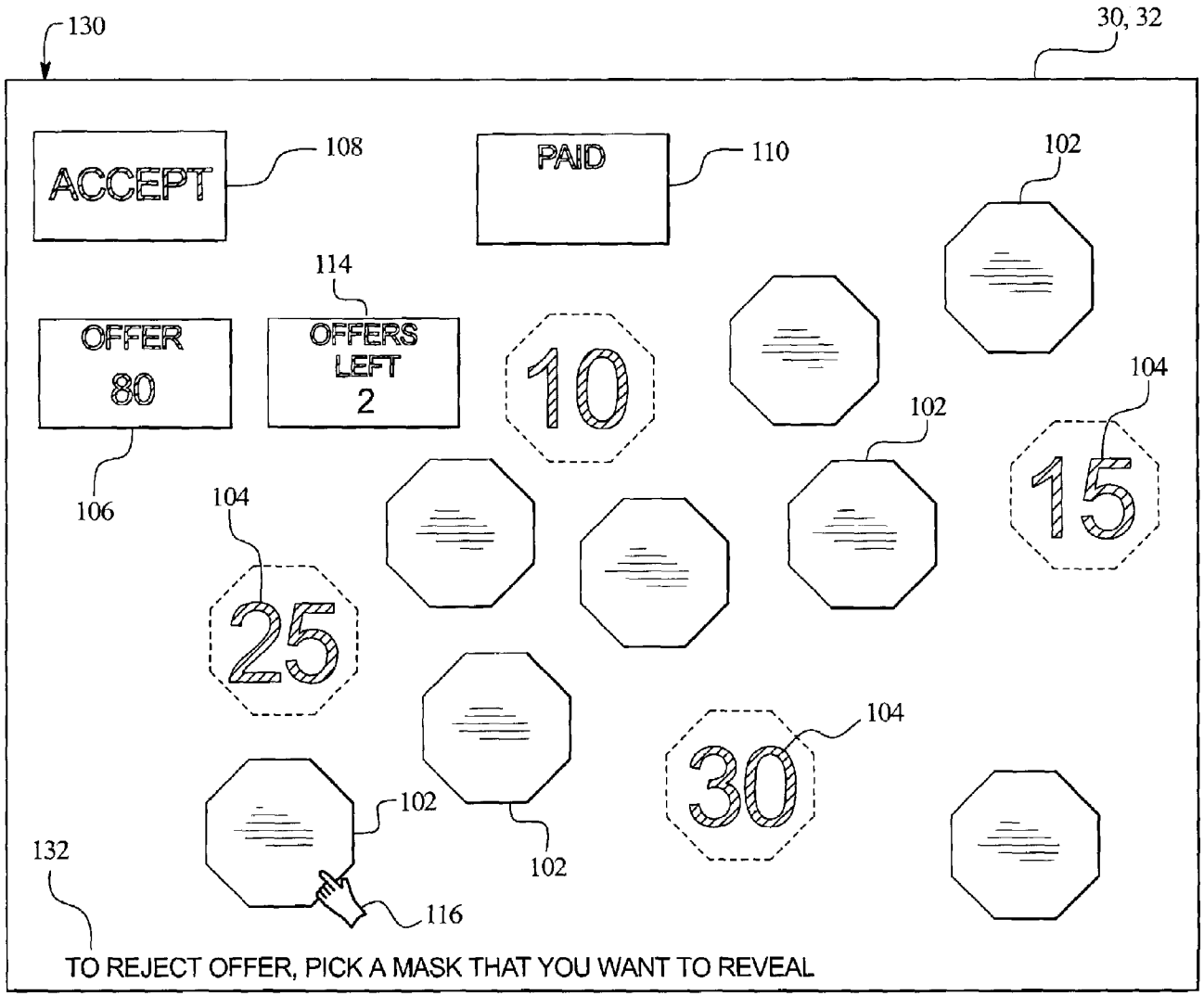

The screens 120 of FIG. 3B and 130 of FIG. 3C illustrate another embodiment, wherein the game relinquishes the random control over which value 104 to mask. The game in this embodiment, however, retains random control over which mask 102 to reveal. In FIG. 3B, the screen 120 provides a suitable audio, visual or audiovisual message 122 informing the player to pick a displayed value 104 that the player wishes to remove from the offer to reject the current offer displayed in the offer display 106. Accordingly, the game does not need or display the reject offer input 112. As illustrated, the player 116 desires to reject the offer and selects to change the displayed value 104 of five.

Referring now to FIG. 3C, the screen 130 illustrates that the game masks the value 104 of five, according to the player's selection, and randomly unmasks or reveals the value 104 of twenty-five. The player's offer increases accordingly to eighty as indicated by the offer display 106. The number of offers remaining decreases to two as indicated by the display 114. In this embodiment, the player picks which value 104 to mask (subtract from offer), but the game chooses which value 104 to unmask or reveal (add to offer). Here, the player eliminates a low value and hopes for a high value replacement.

Figure 3D:
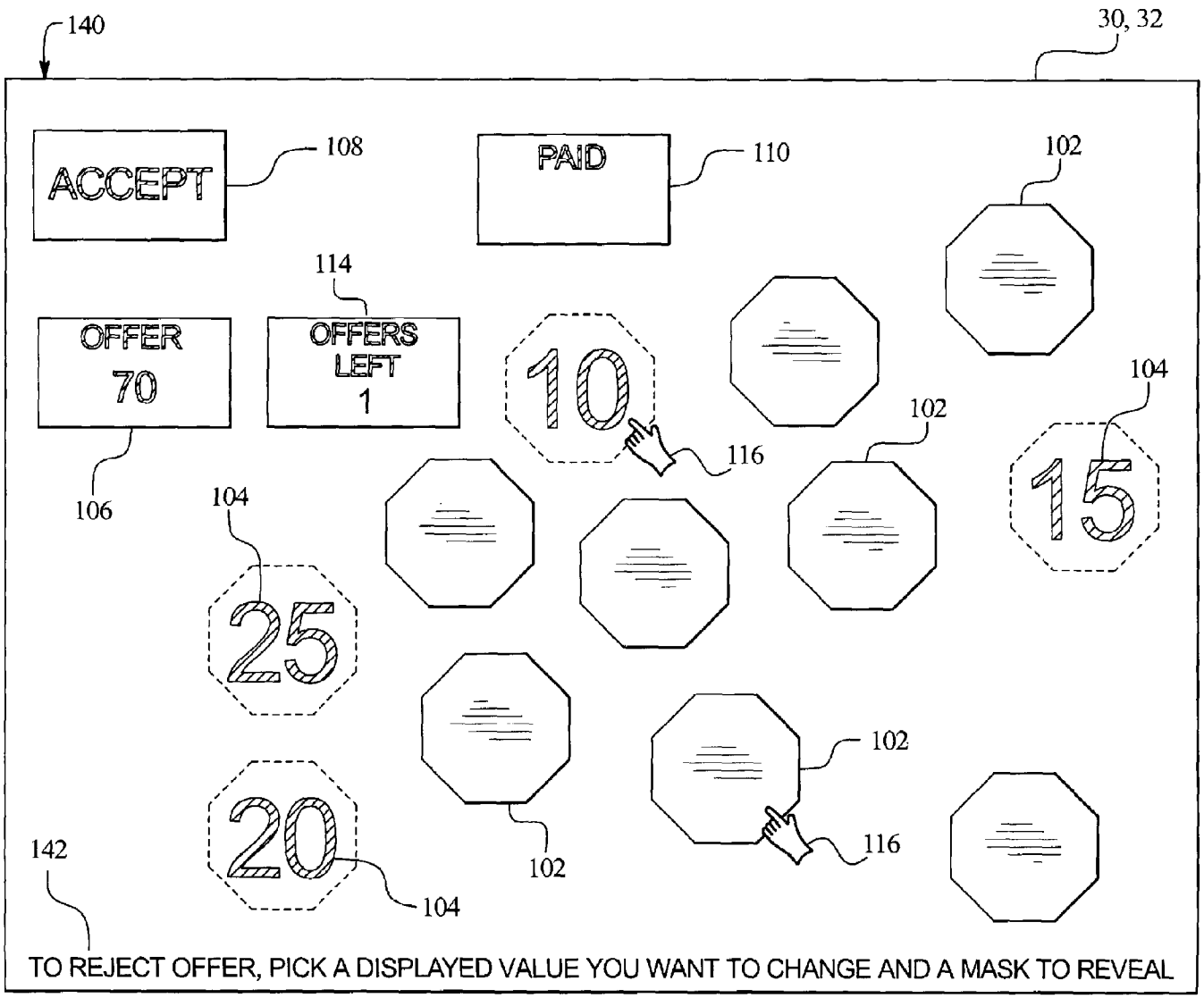

The screens 130 of FIG. 3C and 140 of FIG. 3D illustrate a further embodiment, wherein the game relinquishes the random control over which mask 102 to reveal. The game in this embodiment, however, retains random control over which currently displayed value 104 to mask. In FIG. 3C, the screen 130 provides a suitable audio, visual or audiovisual message 132 informing the player to pick a mask 102 that the player wishes to have revealed in order to reject the current offer displayed in the offer display 106. Accordingly, the game does not need or display the reject offer input 112. As illustrated on the screen 130, the player 116 desires to reject the offer and selects a mask 102 to be revealed.

Referring now to FIG. 3D, the screen 140 illustrates that the game has unmasked the value 104 of twenty, according to the player's selection, and randomly masks the value 104 of thirty previously illustrated in FIG. 3C. The player's offer decreases accordingly to seventy as indicated by the offer display 106. The number of offers remaining decreases to one as indicated by the display 114. In this embodiment, the player picks which value 104 to be unmasked (add to offer), but the game chooses which value 104 to mask (subtract from offer). Here, the player is able to unmask a previously revealed value 104 that the player knows is relatively high (e.g., the value twenty from FIG. 3A) and hopes that the game masks, and therefore removes from the offer, a relatively small value.

The screen 140 of FIG. 3D illustrates yet another embodiment, wherein the game relinquishes random control over which mask 102 to reveal and the value 104 to mask. The game in this embodiment enables the player to pick both the value to add and the value to subtract from the offer. In FIG. 3D, the screen 140 provides a suitable audio, visual or audiovisual message 142 informing the player to pick a mask 102 that the player wishes to be revealed and a value 104 that the player wishes to be masked in order to reject the current offer displayed in the offer display 106. Accordingly, the game does not need or display the reject offer input 112. As illustrated on the screen 140, the player 116 rejects the offer by selecting to reveal the mask 102 that the player knows hides the thirty value 104 (FIG. 3C) and also selects the smallest revealed value 104 of ten to be masked.

In the embodiments displayed in FIGS. 3A through 3D, the game may be adapted to provide a bonus value 104 to the offer instead of subtracting a value 104 from the offer. The game reveals a value 104 by removing its mask 102 but does not simultaneously cover a revealed value 104 with a mask 102. The result is one additional revealed value 104, i.e., five instead of four, each of which contribute to the player's offer. In the embodiment of FIGS. 3A and 3B, when the player selects the reject input 112, the game reveals a value 104 but does not add a mask 102 over a revealed value 104. In the embodiment of FIGS. 3B and 3C, when the player picks a value 104 to reject the offer, the game does not mask the picked value 104. In the embodiment of FIGS. 3C and 3D, the game does not randomly mask a revealed value when the player picks a mask 102 to reveal. Gaming device 10 instead reveals the selected mask but does not mask a previously revealed value. The game may or may not count the bonus value in the offers remaining display 114.

Gaming device 10 is also adaptable to provide a bonus to the player in a different embodiment. Gaming device 10 plays according to one of the embodiments described above in connection with FIGS. 3A to 3D but does not decrease the amount of offers in the offers remaining display. This embodiment provides the player with an extra chance to increase the player's award.

Figure 4A:
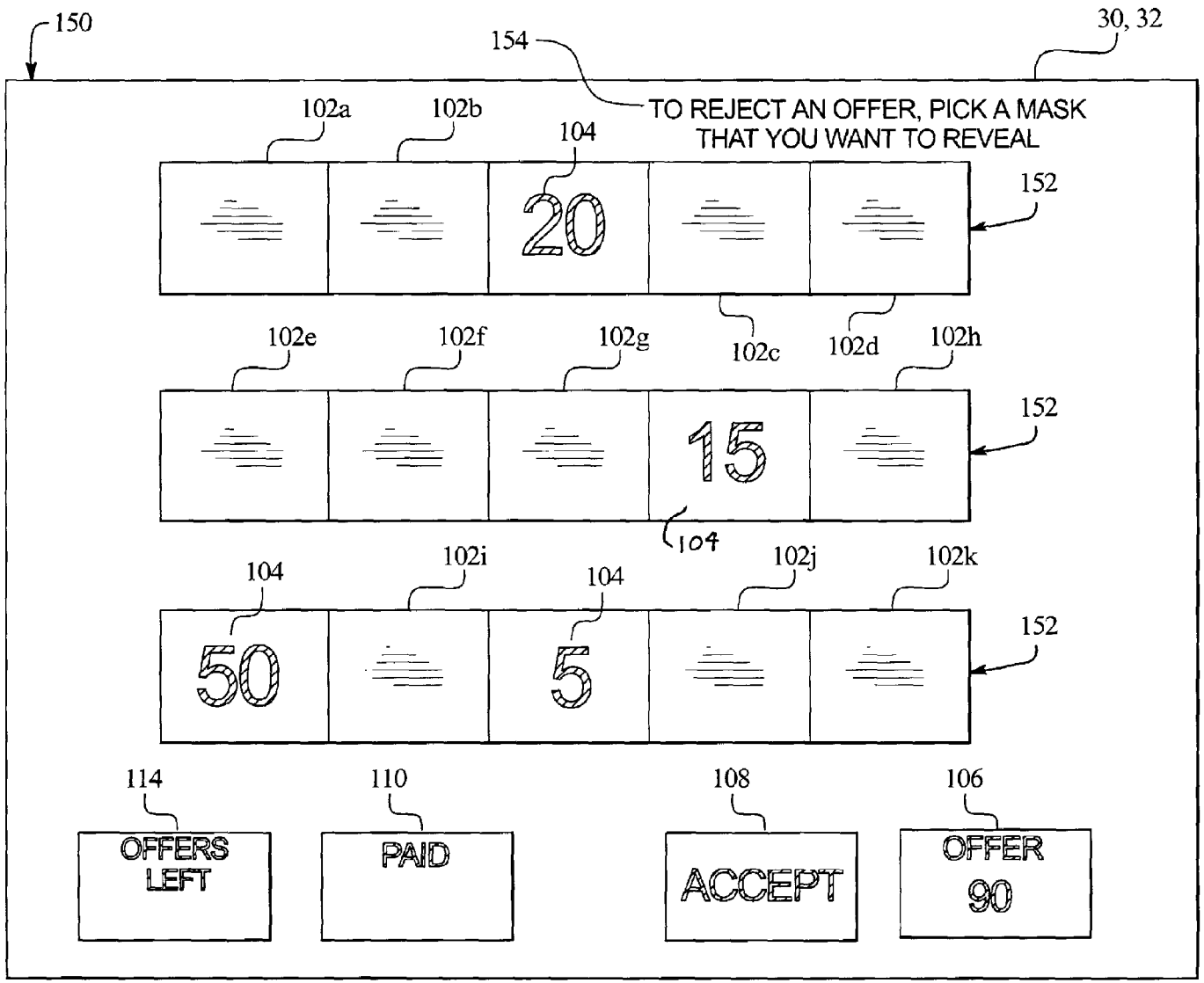
FIGS. 4A and 4B are front elevation views of an embodiment of the present invention, wherein the player is enabled to reject an offer and replace a component of the offer with a masked value from the same row or group as the replaced offer.

Referring now to FIG. 4A, a screen 150 illustrates another embodiment of the present invention, wherein two or more masks are adjacently linked in a row or pattern 152. The screen 150 includes three horizontal rows 152. The game may be adapted, however, to provide any number of straight, curved, horizontal, vertical, diagonal, or otherwise shaped groups. The screen 150 also includes the offer display 106, the accept offer input 108, the paid display 110 and the offers remaining display 114, which have the functionality described above. Although the masks 102 are illustrated as squares, the masks 102 may be any shape desired by the implementers. The adjacent masks of each row 152 preferably abut each other at some point or otherwise indicate their linkage.

The screen 150 provides a suitable audio, visual or audiovisual message 154 informing the player to pick a mask that the player wishes to reveal in order to reject an offer. The game masks a value 104 associated with the row 152 having the mask that the player selects to reveal. For example, if the player selects a mask 102*a* through 102*d* of the top row 152 of the screen 150, the game masks the value 104 of twenty displayed in the top row. The game reveals the mask 102*a* through 102*d* that the player selects. If the player selects a mask 102*e* through 102*h* of the middle row 152 of the screen 150, the game masks the value 104 of fifteen displayed in the middle row. The game reveals the mask 102*e* through 102*h* that the player selects.

The lowest row 152 of the screen 150 has two revealed values 104, namely, fifty and five. If the player picks a mask 102*i* through 102*k* of the lowest row, the game may be adapted to do one of three things. In one implementation, the game assumes the player desires to mask the smallest value 104 and automatically masks it. In the screen 150, the game automatically masks the five value 104. In another implementation, the game provides a suitable audio, visual or audiovisual query (not illustrated) asking the player to indicate the value 104 that the player desires to mask. In this implementation, the player touches the value 104 to be masked.

In yet another implementation, the game masks the value 104 that is closest to the mask that the player selects and suitably informs the player that the game works in this manner. If the player, for example, touches the mask 102*j* or 102*k*, the game automatically masks the five value 104, which is closer to the masks 102*j* and 102*k*. If the player touches the mask 102*i*, which is equally close to two values 104, the game provides a suitable audio, visual or audiovisual query (not illustrated) asking the player to indicate the value 104 that the player desires to mask.

Figure 4B:
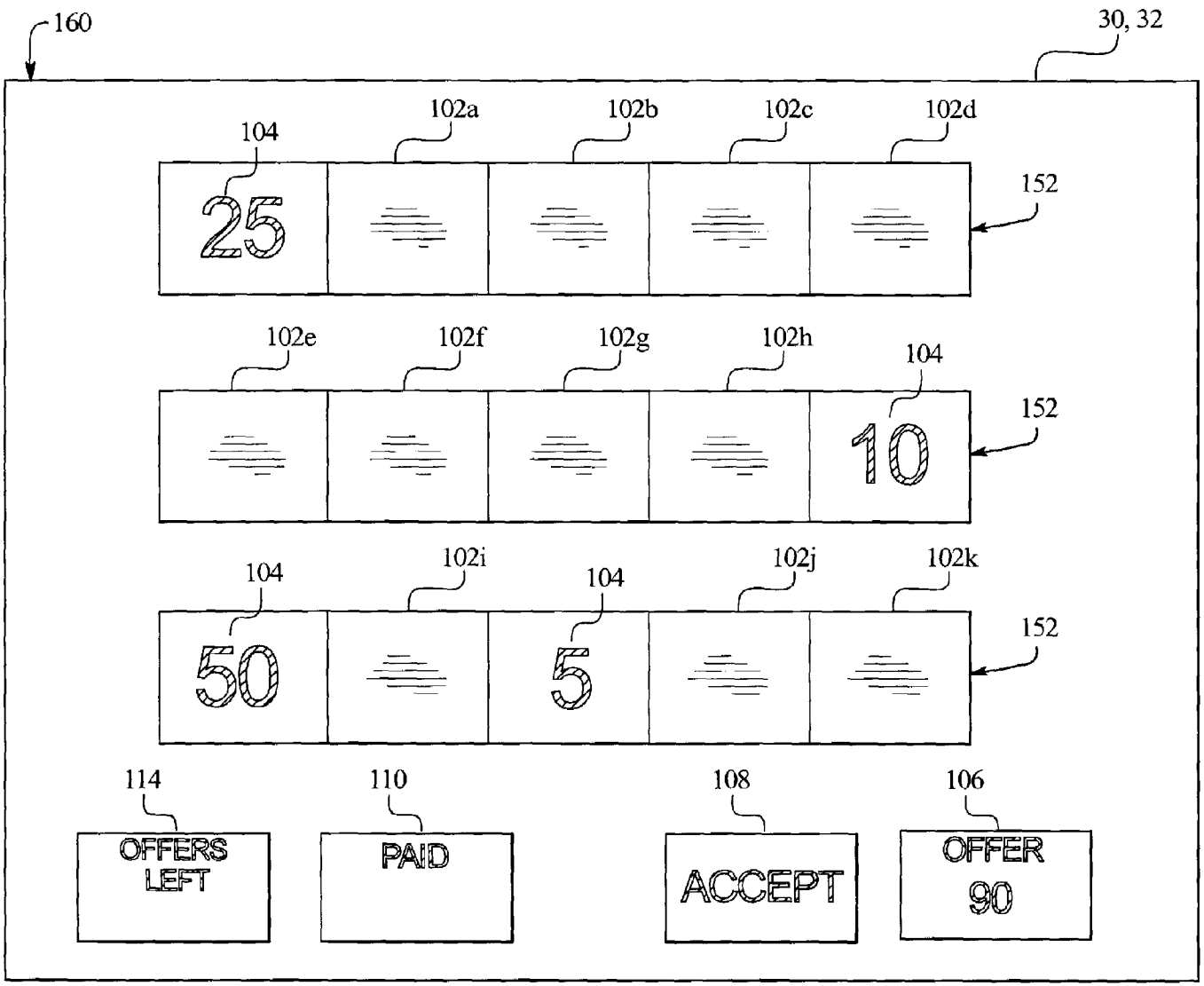

Referring now to FIG. 4B, a screen 160 illustrates one preferred method that the game employs to cover or mask values 104 that are linked in a row or line 152 with one or more masks. In this embodiment, when the player picks a mask, the game slides the selected mask along with any adjacent masks to cover a revealed value 104. For example, if the player selects the mask 102*a* in the position illustrated in the screen 150 of FIG. 4A, the game slides the masks 102*a* and 102*b* to the right to cover the revealed twenty value 104, as illustrated in the screen 160 of FIG. 4B. Consequently, the top row 152 displays the twenty-five value 104 in the position that the mask 102*a* previously held. In another example, if the player selects the mask 102*h* in the position illustrated in the screen 150 of FIG. 4A, the game slides the mask 102*h* to the left to cover the revealed fifteen value 104, as illustrated in the screen 160 of FIG. 4B. Consequently, the middle row 152 displays the ten value 104 in the position that the mask 102*h* previously held.

The lowest row 152 has two revealed values 104. If the player picks a mask 102*i* through 102*k* of the lowest row, the game may be adapted according to one of the implementations described above and thereby: (i) assume the player desires to mask the smallest value 104; (ii) ask the player to indicate the value 104 that the player desires to mask; and (iii) mask the value 104 that is closest to the mask that the player selects.

If the player selects the mask 102*j*, the mask 102*j* in one implementation covers the five value 104 and stops. In another implementation, the mask 102*j* hits the mask 102*i* and both masks move together until the mask 102*i* covers the fifty value 104. Likewise, if the player selects the mask 102*k*, the masks 102*j* and 102*k* in one implementation slide until the mask 102*j* covers the five value 104. In another implementation, the masks 102*j* and 102*k* contact the mask 102*i* and all three masks move together until the mask 102*i* covers the fifty value 104, the mask 102*k* covers the five value 104, revealing the values currently hidden behind masks 102*j* and 102*k* of FIG. 4A. The screen 160 also includes the offer display 106, the accept offer input 108, the paid display 110 and the offers remaining display 114, which have the functionality described above.

Figure 5A:
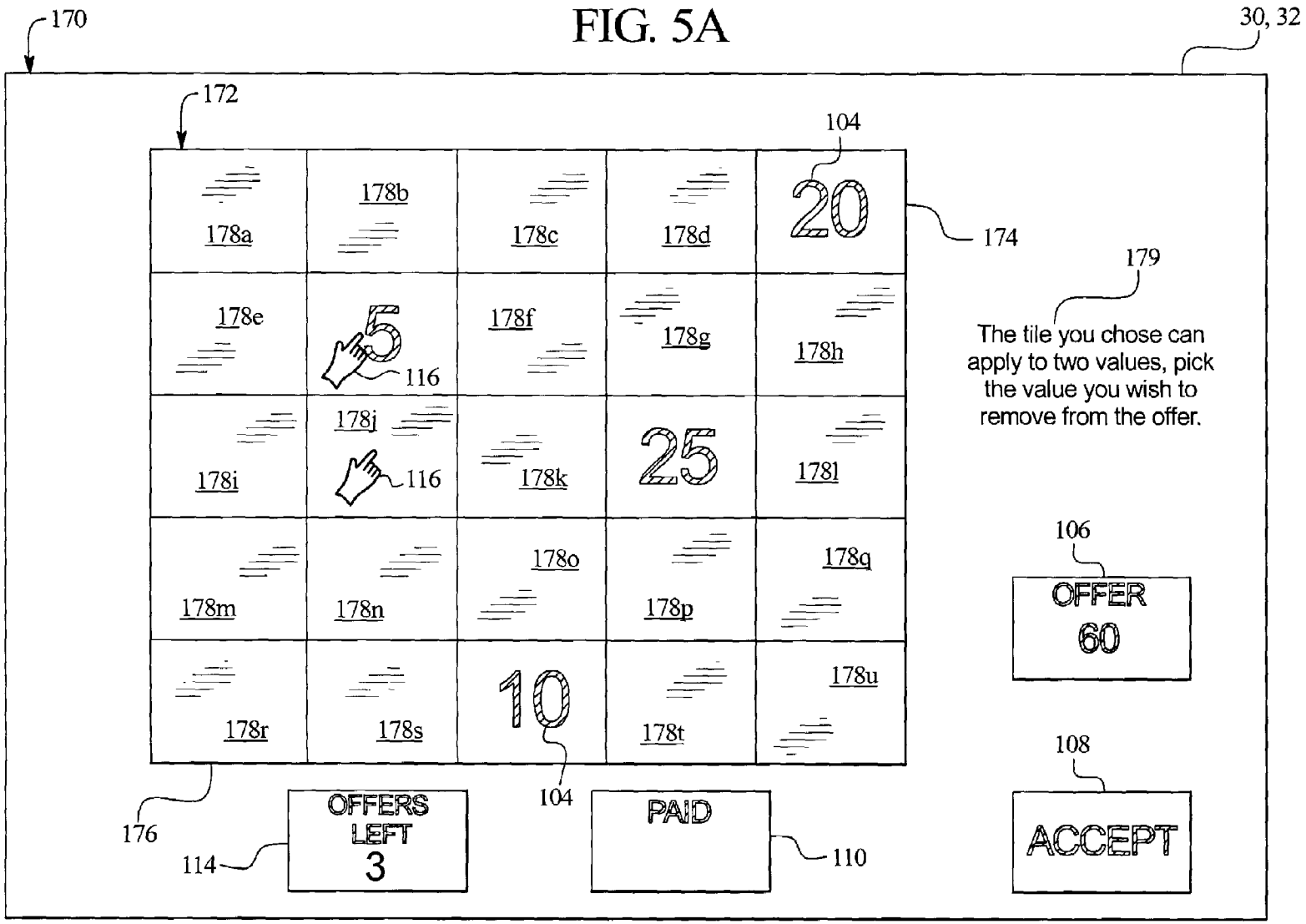
FIGS. 5A to 5C are front elevation views of a preferred embodiment of the present invention having a grid and a plurality of masking tiles, wherein the player is enabled to reject an offer and replace a component of the offer with a revealed tile value masked offer from the same row or column as the replaced value.

Referring now to FIGS. 5A though 5C, one preferred embodiment of the present invention is illustrated, wherein the game provides an offer and an option for the player to upgrade the offer by sliding masking tiles over displayed values 104. The FIGS. 5A through 5C also include the offer display 106, the accept offer input 108, the paid display 110 and the offers remaining display 114, which have the functionality described above.

In FIG. 5A, a screen 170 displays a grid 172 having a plurality of grid rows 174 and grid columns 176. The rows 174 and columns 176 share a plurality of tiles 178*a* through 178*u* and values 104. The grid 172 in one embodiment is rectangular and preferably square. The masking tiles 178*a* through 178*u* are likewise preferably rectangular or square. The grid 172 encompasses each of the embodiments disclosed in connection with FIGS. 4A and 4B. Additionally, the grid 172 enables the player to cover or mask values 104 in two directions. That is, the player may select a tile from the row 174 or the column 176 that encompasses the value 104 the player desires to cover or mask.

Anytime the player chooses to reveal a tile that has two or more values 104 in the row 174 and column 176 encompassing the tile, the game or player must choose one of the tiles. As disclosed above, the game when confronted with this situation may be adapted to: (i) assume the player desires to mask the smallest value 104; (ii) ask the player to indicate the value 104 that the player desires to mask; and (iii) mask the value 104 that is closest to the mask that the player selects. In the grid 172, the game preferably asks the player to indicate the value 104 that the player desires to mask. The player is preferably enabled to respond by pressing or selecting the value 104 that the player desires to mask or eliminate from the offer.

The game may simply mask a value 104 or, preferably, the game slides tiles as described above to mask a value 104. For example, in the screen 170 of FIG. 5A, the player 116 presses the tile 178*j*. The game provides the visual, audio or audiovisual message 179 inquiring whether the player wishes to mask (and eliminate from the offer) the five or the twenty-five value 104. In response, the player 116 selects the five value 104 to mask and remove from the offer displayed in the offer display 106.

Figure 5B:
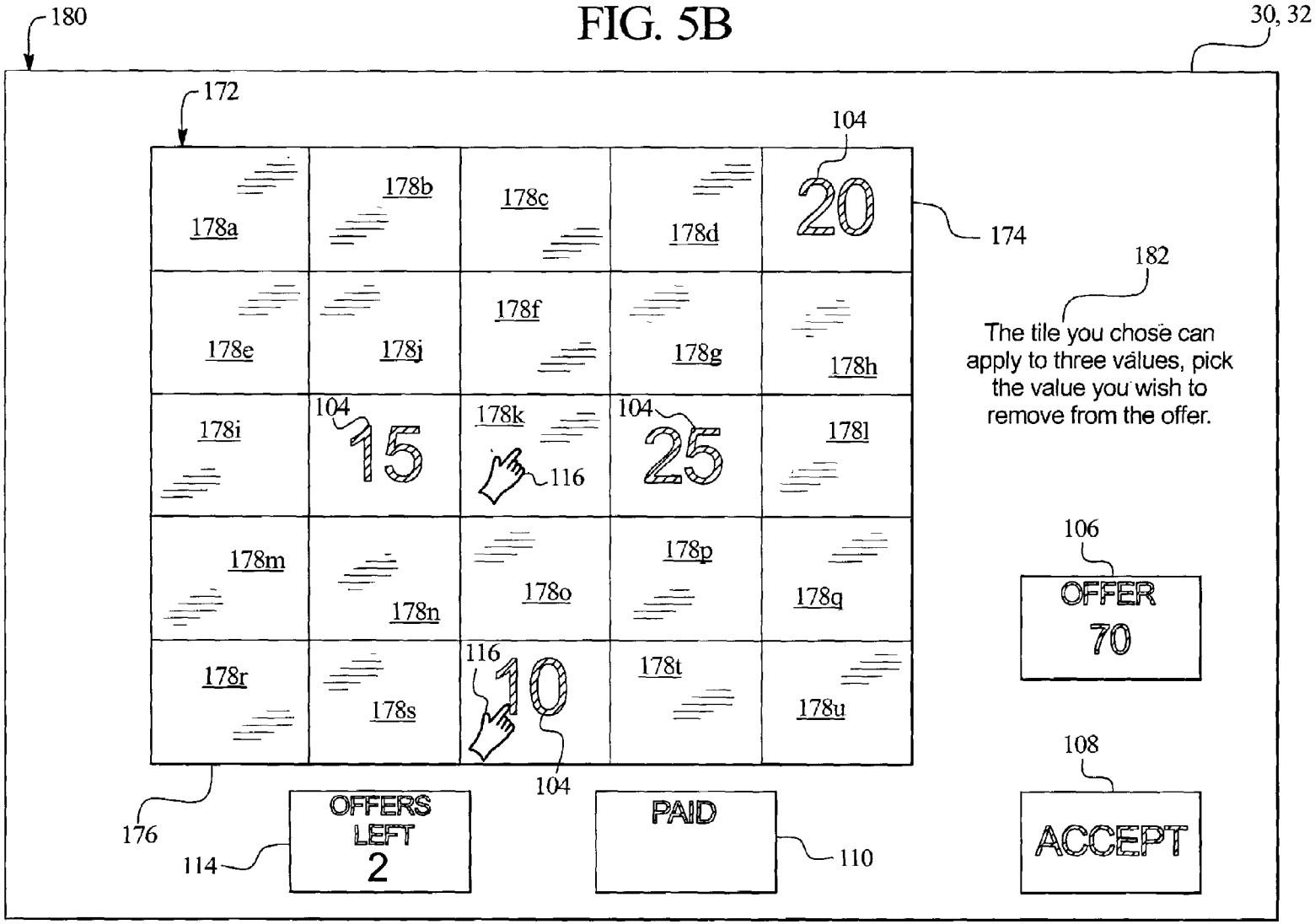

Referring now to the screen 180 of FIG. 5B, the slide 178*j* selected in the screen 170 slides up to cover or mask the five value 104 and to uncover or reveal the fifteen value 104. The five value is removed from the offer, the fifteen value is added to the offer and the net gain of ten is displayed in the offer display 106. The offers remaining display 114 shows one less offer.

In the screen 180, the player 116 rejects the new offer by selecting to reveal the tile 178*k*. The game provides the visual, audio or audiovisual message 182 inquiring whether the player wishes to mask (and eliminate from the offer) the ten, fifteen or twenty-five five value 104. In response, the player 116 selects the ten value 104 to mask and remove from the offer.

Figure 5C:
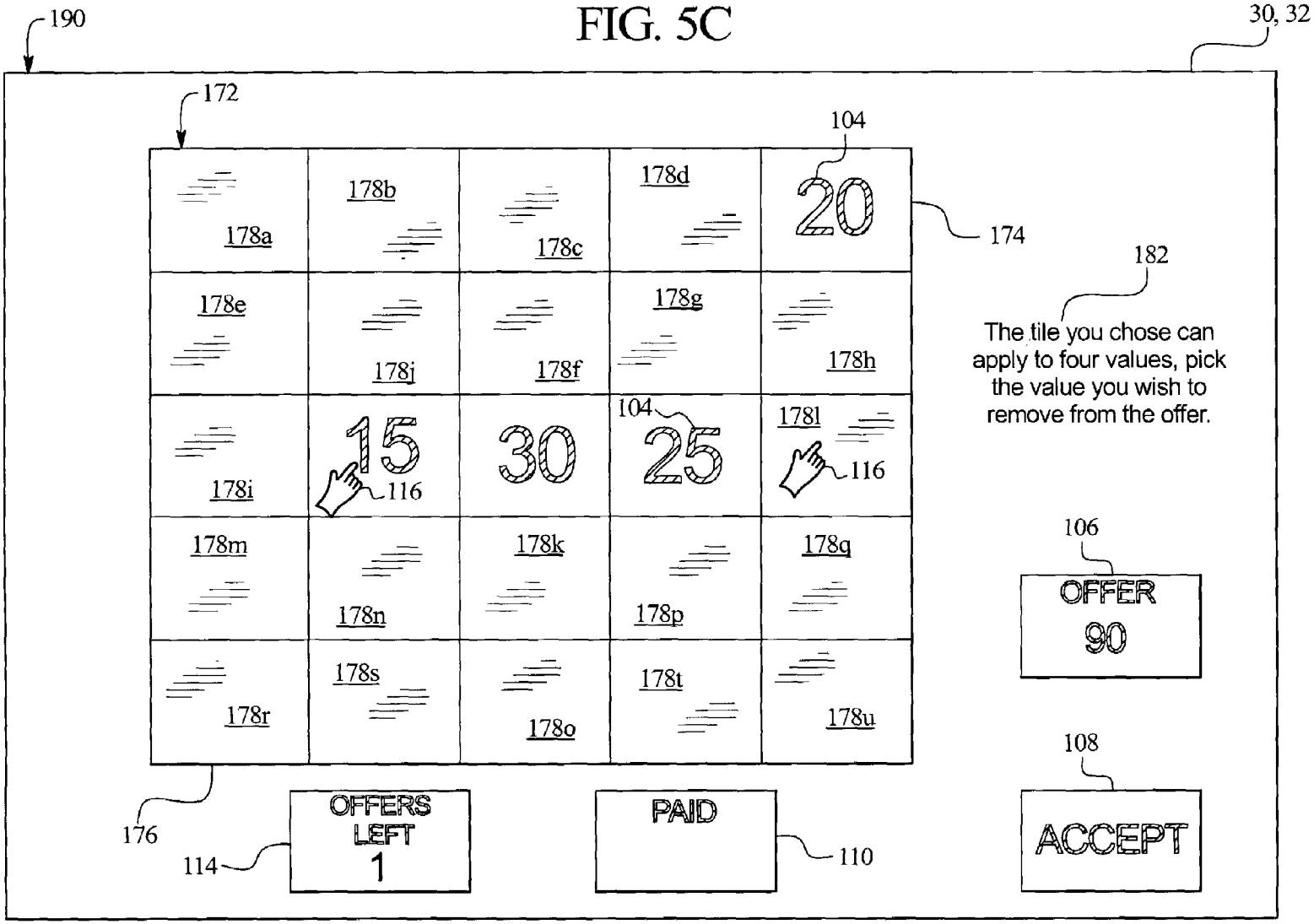

Referring now to the screen 190 of FIG. 5C, the slide 178*k* selected in the screen 180 slides down as does the adjacent slide 178*o*. The slide 178*o* slides down to cover or mask the ten value 104 and to uncover or reveal the thirty value 104. The ten value is removed from the offer, the thirty value is added to the offer and the net gain of twenty is displayed in the offer display 106. The offers remaining display 114 shows one less offer.

In the screen 190, the player 116 rejects the new offer by selecting to reveal the tile 178*l*. The game provides the visual, audio or audiovisual message 182 inquiring whether the player wishes to mask (and eliminate from the offer) the fifteen, twenty, twenty-five or thirty value 104. In response, the player 116 uses the last offer displayed in the offers remaining display 114 and selects the fifteen value 104 to mask and remove from the offer. The tile 178*l* then slides three positions to the left to cover the fifteen value 104, the position of the tile 178*l* displays a new value 104 and the offer display 106 shows the player's final offer.

Each of the embodiments disclosed in FIGS. 4A, 4B and FIGS. 5A through 5C may be adapted to include the bonus value discussed above at the end of FIGS. 3A through 3D. In the embodiments wherein the masks 102 or tiles 178 slide, the player's selection of a mask 102 or tile 178 reveals the mask 102 or tile 178 but no sliding occurs. In this manner, an extra value 104 is revealed. As before, the bonus value 104 may or may not decrease the offers remaining in the display 114.

Figure 6A:
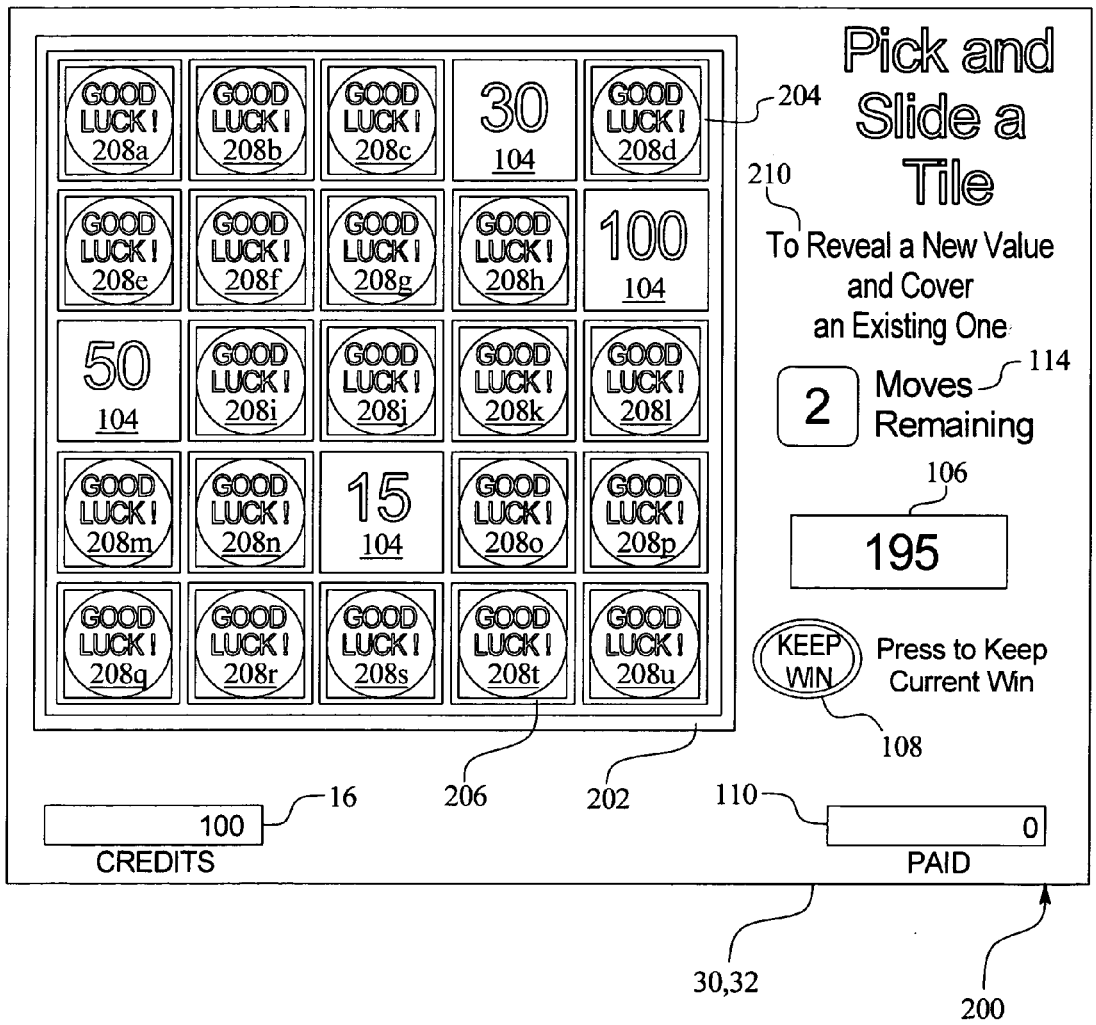
FIGS. 6A to 6C are front elevation views of another preferred embodiment of the present invention having a grid and a plurality of tiles which partially mask the values, wherein the player can reject an offer by touching and sliding one tile to reveal a value beneath the tile and cover and eliminate another value from the offer.
Figure 6B:
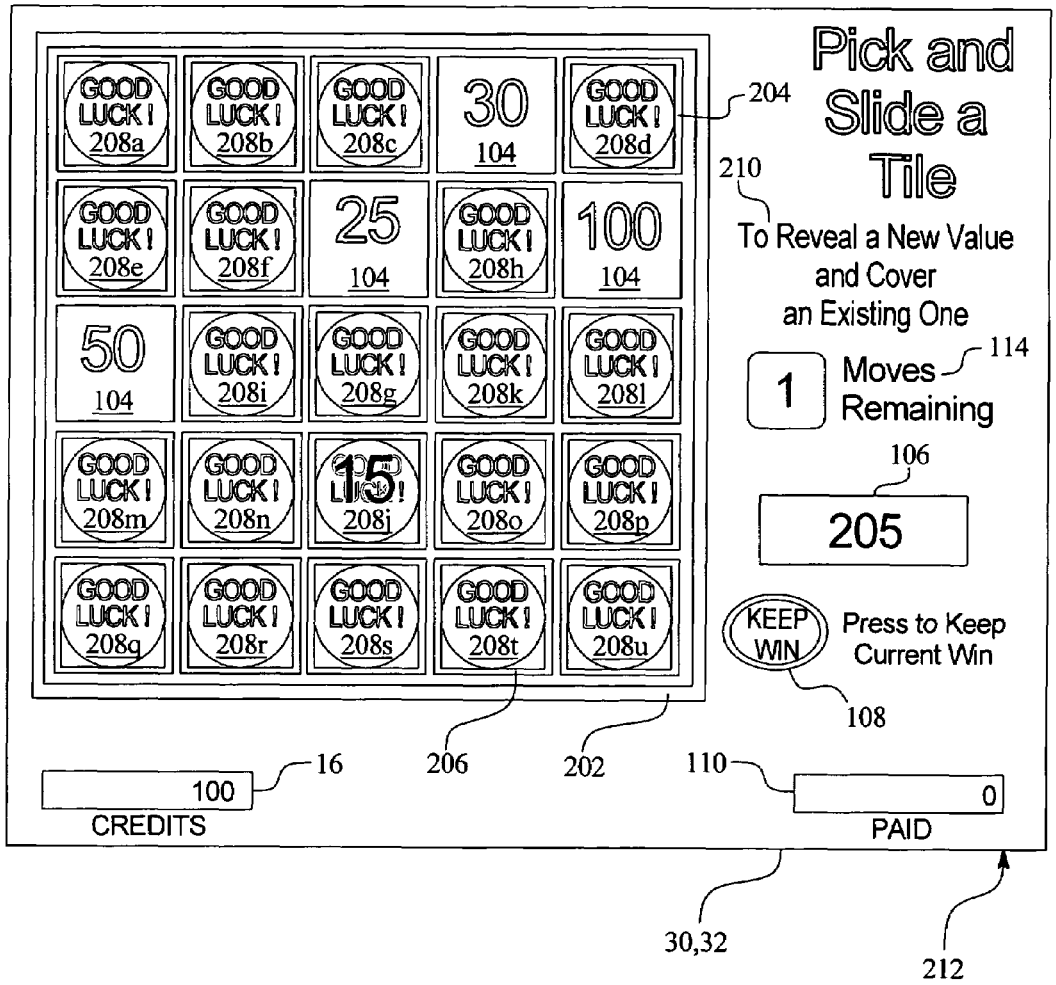
Figure 6C:
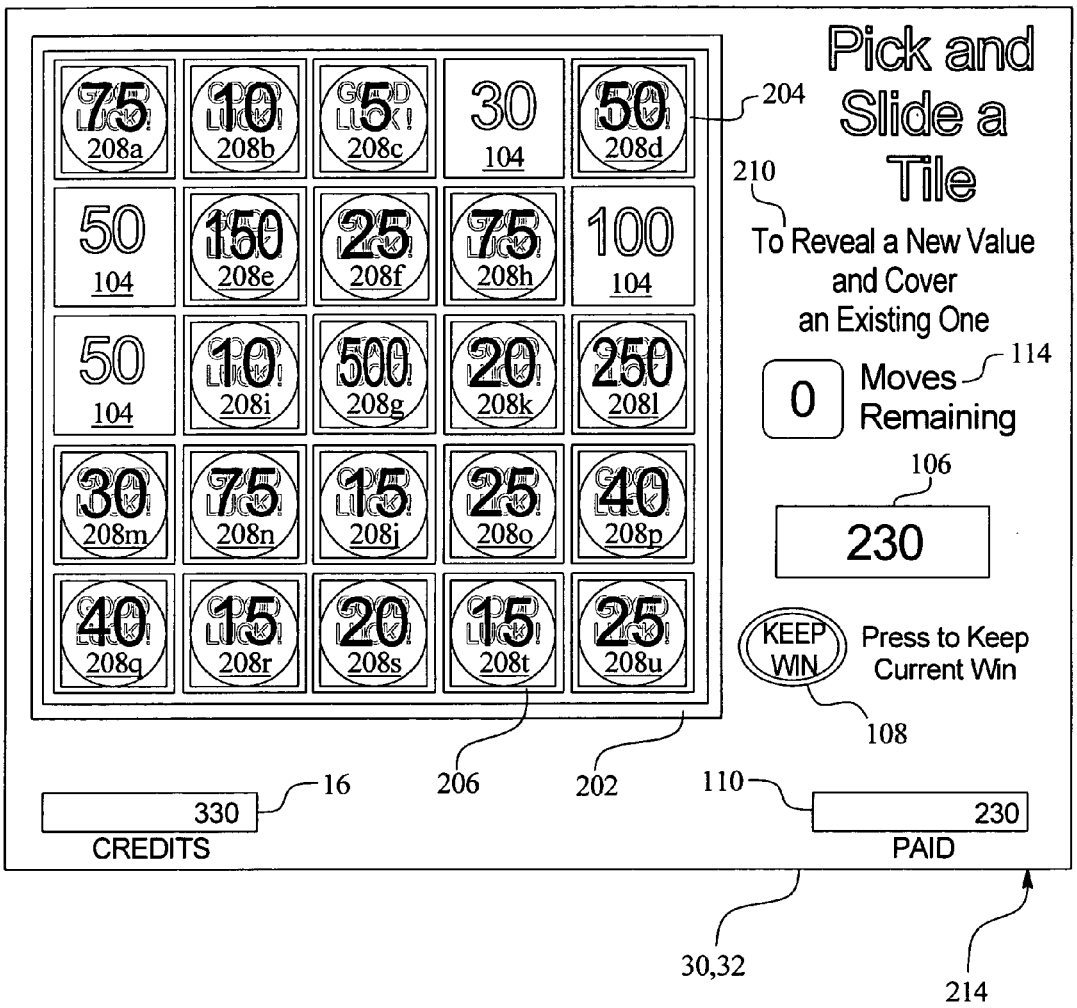

Referring now to FIGS. 6A to 6C, another preferred embodiment of the present invention is illustrated, wherein the game provides an offer and an option for the player to upgrade the offer by touching and sliding one of the masks over one of the displayed values 104. FIGS. 6A to 6C also include the offer display 106, the accept offer input 108, the paid display 110, the offers remaining display 114 and the credit display 16, which have the functionality described above.

In FIG. 6A, a screen 200 displays a grid 202 having a plurality of grid rows 204 and grid columns 206. The rows 204 and columns 206 include a plurality of tiles 208*a* to 208*u*. The rows and columns also include and display a number of values 104 including the currently displayed values 15, 30, 50 and 100. The offer, which is based on these values and in one embodiment a mathematical combination such as a sum of each of these displayed values 104, is one hundred ninety-five and is displayed in the offer display 106.

As with the grid 172 in FIGS. 5A to 5C, the grid 206 is rectangular and in one embodiment is square. The tiles 208*a* to 208*u* are likewise rectangular or square. Gaming device 10, via grid 202, enables the player to cover or mask values in two directions. The player can select one of the tiles from the row 204 or the column 206 that includes the value 104 that the player desires to cover or mask, i.e., remove from the current offer.

The screen also illustrates that the player has up to two additional offers illustrated in the offers remaining display 114. The player can otherwise keep the current offer of one hundred ninety-five by selecting the accept offer input 108.

The screen 200 also provides a message 210 to the player to touch and slide a tile to reveal a new value and to cover a currently displayed tile. Message 210 can be an audio, visual or audiovisual message.

The touch screen 50 operating in conjunction with the touch screen controller 52 and the processor 38 enables a player's touch of one of the tiles 208*a* to 208*u* to be sensed. Further, touch screen 50 can also sense when the finger of the player moves on the display device 30 or 32. For example, the touch screen 50 is sensitive enough to discern whether the player presses the left side of tile 208*c*, the top of same, the bottom of same or the right side of tile 208*c*. Likewise, touch screen 50 can sense when the player moves the player's finger from the tile 208*c* to the area of the display device 30 or 32 where the value 104 thirty resides. The software can therefore be configured so that gaming device 10 remembers which tile the player initially touches and makes a comparison between where the tile was originally touched and where the player's finger currently touches.

Gaming device 10 in an embodiment requires a continuous input or a continuous touch from the time when the player initially touches one of the tiles to when the player removes the player's finger from the touch screen 50 of the display device 30 or 32. For example, gaming device 10 in an embodiment deems that a player makes a decision when the player removes the player's finger from the touch screen 50 of the display device 30 or 32. Here, gaming device 10 enables the player to slide one or more of the tiles to a new position, reverse direction, and slide the tiles back to the original position without removing the player's finger from the touch screen input device. In this manner, gaming device 10 enables the player to change the player's mind when selecting which values 104 to remove from the offer and/or which tiles to use to change the offer.

The gaming device software determines the point at which a tile covers one of the values 104. That is, for example, if the player moves the tile 208*c* only half-way across the value 104, gaming device 10 in an embodiment assumes or determines that 208*c* now covers the value 104 thirty and reveals the value 104 currently underneath the tile 208*c*. In one preferred embodiment, there is no turning back once the player touches and slides the tile at least half-way or in a manner which causes the associated value to be revealed. To prevent the player from trying to view the value before completely moving a tile, gaming device 10 hides the value 104 in this embodiment until the player completes a tile move. Upon completion, gaming device 10 displays the value that has been hidden behind the tile. If the player moves a tile or tiles only a quarter way or less than half-way across a displayed value 104 and releases the tile, gaming device 10 in an embodiment automatically snaps the tile or tiles back into position. The software and algorithms used to determine when a tile has been moved officially can be modified by those of skill in the art.

Referring now to FIG. 6B, the player has decided to cover the value 104 of fifteen displayed in FIG. 6A. Viewing FIG. 6A, after making such a determination the player has a number of options in covering the value fifteen. The player can touch and move either of the tiles 208*m* or 208*n* and move same one position to the right. The player can touch tile 208*s* and slide same one position upward. The player can touch either tiles 208*o* or 208*p* and move same one position to the left. Finally, the player can touch any of the tiles 208*c*, 208*g* or 208*j* and move same one position downward.

It should be appreciated that certain tiles cannot be moved in the arrangement of FIG. 6A. For example, there is no way for the player to view the value behind 208*r*. In order to view the value behind 208*r*, the player must first move another one of the tiles and use one of the remaining offers. In FIG. 6B, the player has moved the tiles 208*g* and tile 208*j* each down one position, so that the value 104 of twenty-five previously behind the tile 208*g* is exposed. Gaming device 10 removes the offer component of fifteen from the offer and adds the value of twenty-five to the new offer, yielding two hundred five as illustrated in the offer display 106.

To move both the tiles 208*g* and 208*j*, the player touches the tile 208*g* and gaming device 10 knows that the potential moves (in FIG. 6A) are either to the right towards the value one hundred or downward towards the value fifteen. Once gaming device 10 senses that the player's finger is moving downwards, the gaming device 10, knowing that the tile 208*g* sits above tile 208*j*, causes the tiles 208*g* and 208*j* to move accordingly. As illustrated in FIG. 6B, the player at this point in the game still cannot see what is behind tile 208*r*. The number of offers remaining decreases from two to one as illustrated by the moves remaining indicator 114.

Referring now to FIG. 6C, the player uses the last remaining offer rejection as indicated by the moves remaining indicator 114 to move the tiles 208*e* and 208*f* each one position to the right to cover the value 104 of twenty-five illustrated in FIG. 6B. The newly revealed value 104 of fifty previously masked behind tile 208*e* is added to the new offer, and the previously displayed value of twenty-five is subtracted from the offer, as illustrated in the offer display 106. Because the player has no moves remaining, gaming device 10 pays the final offer of two hundred thirty credits to the player as illustrated by the paid display 110 and updates the player's credits from one hundred to three hundred thirty as illustrated by the credit display 16.

If the player had wanted to remove both the value 104 of twenty-five and the value 104 of one hundred in FIG. 6B, the player could have continued to move the tiles 208*e* and 208*f* to the right, thereby contacting and pushing the tile 208*h* to the right so that the tiles 208*e*, 208*f* and 208*h* would cover the right three tiles in the second row 204 of grid 202. In such a case, the left two values of that row would then be displayed and counted in the final offer. Thus, it should be appreciated that the game enables the player to move a plurality of tiles simultaneously, for example by moving one tile toward the direction of an adjacent tile which is adjacent to a revealed value.

FIGS. 6A to 6C illustrate an embodiment of the present invention, wherein gaming device 10 only partially masks the values that the player decides to mask. That is, gaming device 10 in FIG. 6B partially covers but also displays the value fifteen that the player masks with the tile 208*j*. In this manner, gaming device 10 provides the player with a reminder of the values that the player has covered and the amount of the values. Gaming device 10 in the illustrated embodiment covers values not yet seen by the player completely as seen in FIGS. 6A and 6B. Upon ending the game illustrated in FIG. 6C, gaming device 10 reveals each of the values in addition to the values currently displayed as part of the final offer. For example, the player can see in FIG. 6C that the tile 208*g* covers the highest value of the grid 202 of five hundred. Revealing what the player could have been awarded increases the overall excitement and enjoyment of the game.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a display device;

a plurality of values revealable by the display device;

a number of masks greater than zero and less than the plurality of values, each said mask individually displayed by the display device in place of at least one of the values; and a processor that:

(i) controls the display device, (ii) provides an offer to a player based on a plurality of revealed values displayed by the display device, the revealed values being a subset of the revealable values, and (iii) provides, upon a reject offer input from a player, a new offer that is at least based on one of the revealable values not in the subset that the display device reveals in exchange for one of the previously revealed values, and wherein the display device displays one of the masks in place of said previously revealed value.

2. The gaming device of claim 1, wherein the reject offer input includes a touch screen that operates with the display device and the masks to enable the player to select one of the masks.

3. The gaming device of claim 1, which includes a touch screen that cooperates with the display device to provide an accept offer input.

4. The gaming device of claim 1, wherein the reject offer input includes a touch screen that operates with the display device to enable the player to touch and drag one of the masks from one of the values to another one of the values.

5. The gaming device of claim 1, wherein the reject offer input includes a touch screen that operates with the display device to enable the player to drag a plurality of adjacent masks from a first plurality of values to a second plurality of values.

6. The gaming device of claim 1, which includes two adjacent masks and one of the revealed values adjacent to one of the masks, wherein one of: (i) the mask adjacent to the revealed value is moveable, and (ii) both masks are alternatively moveable so that the mask adjacent to the revealed value covers the revealed value.

7. The gaming device of claim 6, which includes a first newly revealed value if only the adjacent mask is moved and a second newly revealed value if both masks are moved.

8. The gaming device of claim 6, wherein both masks are selectable areas of a touch screen that operates with the display device.

9. The gaming device of claim 6, wherein both masks are slideable areas of a touch screen that operates with the display device.

10. The gaming device of claim 1, which includes three adjacent masks and one of the revealed values adjacent to one of the masks wherein one of: (i) the mask adjacent to the revealed value is moveable, (ii) the adjacent mask and the mask adjacent to it are moveable, and (iii) all three masks are alternatively moveable so that the mask adjacent to the revealed value covers the revealed value.

11. The gaming device of claim 10, which includes a first newly revealed value if only the adjacent mask is moved, a second newly revealed value if two masks are moved and a third newly revealed value if all three masks are moved.

12. The gaming device of claim 10, wherein the three masks are each selectable areas of a touch screen that operates with the display device.

13. The gaming device of claim 10, wherein the three masks are each slideable areas of a touch screen that operates with the display device.

14. The gaming device of claim 1, wherein one of the masks is adjacent to two revealed values, and which includes an input that enables the player to indicate which revealed value to cover with the mask.

15. The gaming device of claim 1, wherein one of the masks is adjacent to two revealed values, and which includes a touch screen that enables the player to touch and move the mask to cover a desired one of the revealed values.

16. The gaming device of claim 1, wherein a plurality of the masks are adjacent to two revealed values, and which includes an input that enables the player to select a desired one of the masks to cover a desired one of the revealed values.

17. The gaming device of claim 1, wherein a plurality of the masks are adjacent to two revealed values, and which includes a touch screen that enables the player to touch and move one of the adjacent masks to cover a desired one of the revealed values.

18. The gaming device of claim 1, wherein the new offers are computed by applying a mathematical operation to the previously and newly masked values.

19. The gaming device of claim 1, wherein the unmasked value is spatially related to the masked value.

20. The gaming device of claim 1, wherein the new offer is computed by offsetting the newly unmasked value with the newly masked value.

21. The gaming device of claim 1, which includes a plurality of offers that each include movement of at least one of the masks to reveal at least one of the masked values and to cover at least one of the revealed values.

22. The gaming device of claim 1, wherein displaying the one of the masks displayed in place of said previously revealed value includes causing said mask to be colored to allow said previously revealed value to be seen while said mask is displayed.

23. The gaming device of claim 1, which includes a bonus value provided to the player, wherein one of the masks reveals the bonus value instead of one of the values.

24. The gaming device of claim 1, which includes a bonus provided to the player in which a selection of the reject offer input does not count as one of a predetermined number of offer rejections.

25. A gaming device comprising:

a display device;

a plurality of values revealable by the display device;

a number of masks greater than zero and less than the plurality of values, each said mask individually displayed by the display device in place of at least one of the values;

an offer provided to a player, the offer based on a plurality of the revealable values that are revealed to the player by the display device, wherein at least one of the revealable values is masked by at least one of the masks; and a processor that:

(i) causes the display device to reveal at least one masked value and in exchange causes the display device to mask at least one revealed value upon a reject offer input from the player, and (ii) provides a new offer based on a difference between said newly revealed value and said newly masked value.

26. The gaming device of claim 25, wherein the reject offer input includes a touch screen operable with the display device to allow the player to touch and move one of the masks.

27. A gaming device comprising:

a display device;

a plurality of values revealable by the display device;

a number of masks less than the number of values, each said mask individually displayed by the display device in place of at least one of the values;

an offer provided to a player, the offer based on a plurality of the revealable values that are revealed to the player by the display device, wherein at least one of the revealable values is masked by at least one of the masks; and a processor that:

(i) causes the display device to reveal at least one randomly generated masked value, (ii) causes the display device to mask at least one randomly generated revealed value upon a reject offer input from the player, and (iii) provides a new offer based on at least one newly revealed value.

28. The gaming device of claim 27, wherein the new offer is computed based on at least one newly revealed value and at least one newly masked value.

29. A gaming device comprising:

a display device;

a plurality of values revealable by the display device;

a number of masks less than the number of values, each said mask individually displayed by the display device in place of at least one of the values;

an offer provided to a player, the offer based on a plurality of the revealable values that are revealed to the player by the display device, wherein at least one of the revealable values is masked by at least one of the masks; and a processor that:

(i) causes the display device to reveal at least one randomly generated masked value, (ii) causes the display device to mask at least one player selected revealed value upon a reject offer input from the player, and (iii) provides a new offer based on at least one newly revealed value.

30. The gaming device of claim 29, wherein the reject offer input includes the selection of the player selected revealed value.

31. A gaming device comprising:

a display device;

a plurality of values revealable by the display device;

a number of masks less than the number of values, each said mask individually displayed by the display device in place of at least one of the values;

an offer provided to a player, the offer based on a plurality of the revealable values that are revealed to the player by the display device, wherein at least one of the revealable values is masked by at least one of the masks; and a processor that:

(i) causes the display device to reveal at least one player selected masked value, (ii) causes the display device to mask at least one randomly generated revealed value upon a reject offer input from the player, and (iii) provides a new offer based on at least one newly revealed value.

32. The gaming device of claim 31, wherein the reject offer input includes the selection of the player selected revealed value.

33. A gaming device comprising:

a display device;

a plurality of values revealable by the display device;

a number of masks less than the number of values, each said mask individually displayed by the display device in place of at least one of the values;

an offer provided to a player, the offer based on a plurality of the revealable values that are revealed to the player; and a processor that:

(i) causes the display device to reveal at least one player selected masked value, (ii) causes the display device to mask at least one player selected revealed value upon a reject offer input from the player, and (iii) provides a new offer based on at least one newly revealed value.

34. The gaming device of claim 33, wherein the reject offer input includes the selection of one of the player selected masked value and the player selected revealed value.

35. A gaming device comprising:

a display device;

a grid displayed by the display device having a plurality of revealable values;

a number of tiles within the grid that are individually displayed by the display device in place of at least one of the values;

an offer provided to a player, the offer based on at least one of the values that is revealed within the grid; and a processor that:

(i) causes the display device to reveal at least one of the tiled values and in exchange covers at least one revealed value upon a reject offer input from a player, and (ii) provides a new offer based on at least one newly revealed value.

36. The gaming device of claim 35, wherein the reject offer input includes a touch screen that operates with the display device to enable the player to touch and drag one of the tiles from one of the values to another one of the values.

37. The gaming device of claim 35, wherein the reject offer input includes a touch screen that operates with the display device to enable the player to drag a plurality of adjacent tiles from a first plurality of values to a second plurality of values.

38. The gaming device of claim 35, wherein the grid includes two adjacent tiles and one of the revealed values adjacent to one of the tiles, wherein one of: (i) the tile adjacent to the revealed value is moveable and (ii) both tiles are moveable so that the tile adjacent to the revealed value covers cover the revealed value.

39. The gaming device of claim 38, which includes a first newly revealed value if the adjacent tile is moved and a second newly revealed value if both tiles are moved.

40. The gaming device of claim 38, wherein both tiles are selectable areas of a touch screen that operates with the display device.

41. The gaming device of claim 38, wherein both tiles are slideable areas of a touch screen that operates with the display device.

42. The gaming device of claim 35, wherein the grid includes three adjacent tiles and one of the revealed values adjacent to one of the tiles wherein one of: (i) the tile adjacent to the revealed value is moveable, (ii) the adjacent tile and the tile adjacent to it are moveable, and (iii) all three tiles are moveable so that the tile adjacent to the revealed value covers the revealed value.

43. The gaming device of claim 42, which includes a first newly revealed value if the adjacent tile is moved, a second newly revealed value if two tiles are moved and a third newly revealed value if all three tiles are moved.

44. The gaming device of claim 42, wherein the three tiles are each selectable areas of a touch screen that operates with the processor.

45. The gaming device of claim 42, wherein the three tiles are each slideable areas of a touch screen that operates with the display device.

46. The gaming device of claim 35, wherein one of the tiles is adjacent to two revealed values, and which includes an input for indicating which revealed value to cover with the tile.

47. The gaming device of claim 35, wherein one of the tiles is adjacent to two revealed values, and which includes a touch screen that enables the player to touch and move the tile to cover a desired one of the revealed values.

48. The gaming device of claim 35, wherein a plurality of the tiles are adjacent to two revealed values, and which includes an input for indicating which revealed value to cover with one of the tiles.

49. The gaming device of claim 35, wherein a plurality of the tiles are adjacent to two revealed values, and which includes a touch screen that enables the player to touch and move one of the adjacent tiles to cover a desired one of the revealed values.

50. A method for operating a gaming device comprising the steps of:

(a) revealing at least one value on a grid of values and covering each of the other values in the grid with a tile;

(b) providing a first offer to a player that is based on the at least one revealed value;

(c) enabling the player to reject the first offer by moving a tile in the grid in place of one of the revealed values, revealing a newly revealed value; and (d) providing a second offer to the player that is based on the newly revealed value.

51. The method of claim 50, which includes enabling the player to reject a predetermined number of offers by moving selected tiles to cover revealed values, creating newly revealed tiles and new offers based on the newly revealed tiles.

52. The method of claim 50, which includes enabling the player to accept one of the offers and receive an award that is based on a mathematical combination of each currently revealed value.

53. The method of claim 50, which includes generating a bonus value for the player, wherein one of the tiles selected to cover one of the revealed values is instead removed to reveal the bonus value.

54. The method of claim 50, which includes providing a bonus to the player that includes not counting an offer rejection by the player as one of a predetermined number of offer rejections provided to the player.

55. The method of claim 50, which includes providing steps (a) to (d) through a data network.

56. The method of claim 55, wherein the data network is an internet.

57. A method of operating a gaming device comprising the steps of:

displaying a number of masks in place of less than all of a plurality of values so that at least one of the values is a revealed value;

providing an offer to a player based on at least one of the revealed values;

enabling a player to touch a mask and slide at least one of the masks to reveal a previously masked value and thereby mask a previously revealed value upon a reject offer input from the player; and providing a new offer based on the newly revealed value.

58. The method of claim 57, which includes computing the new offer based on a difference between the newly revealed value and the newly masked value.

59. A method of operating a gaming device comprising the steps of:

displaying a number of masks in place of less than all of a plurality of values so that a set of the values is revealed;

providing an offer to a player based on the set of revealed values;

enabling the player to change the offer by moving at least one mask to change the set of values that are revealed; and visually configuring the masks and the revealed values so that player's choice of one of the masks to move limits which values can be revealed.

60. The method of claim 59, which includes configuring the masks and the revealed values so that the player has to select to make two moves to reveal a value desired by the player.

61. A method of operating a gaming device comprising the steps of:

displaying a number of masks in place of less than all of a plurality of values so that a set of values is revealed;

providing an offer to a player based on the set of revealed values;

enabling the player to change the offer by moving at least one mask to change the set of values that are revealed; and visually configuring the masks and the values so that a limited number of masks can be selected to be moved to reveal a value desired by the player.

62. The method of claim 61, which includes configuring the masks and values so that at least one value cannot be revealed in one move.

63. The method of claim 61, wherein a value is revealable only through selecting, for movement, a mask in a same row or column as the value.

64. A method of operating a gaming device comprising the steps of:

displaying a number of masks in place of less than all of a plurality of values so that at least one of the values is a revealed value;

providing an offer to a player based on at least one revealed value;

enabling the player to select at least one masked value to reveal and at least one revealed value to mask to reject the offer;

revealing at least one player selected previously masked value upon masking at least one player selected previously revealed value; and providing a new offer based on at least one newly revealed value.

65. The method of claim 64, which includes displaying at least one mask move to cover the at least one player selected previously revealed value.

* * * * *